US010487625B2

(12) United States Patent
Jacob

(10) Patent No.: US 10,487,625 B2
(45) Date of Patent: Nov. 26, 2019

(54) SEGMENTED RING ASSEMBLY

(71) Applicant: Schlumberger Technology Corporation, Sugar Land, TX (US)

(72) Inventor: Gregoire Jacob, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 923 days.

(21) Appl. No.: 14/269,304

(22) Filed: May 5, 2014

(65) Prior Publication Data

US 2015/0075816 A1 Mar. 19, 2015

Related U.S. Application Data

(63) Continuation-in-part of application No. 14/029,936, filed on Sep. 18, 2013.

(60) Provisional application No. 61/905,328, filed on Nov. 18, 2013.

(51) Int. Cl.

| | |
|---|---|
| ***E21B 34/14*** | (2006.01) |
| ***E21B 23/00*** | (2006.01) |
| ***E21B 43/10*** | (2006.01) |

(52) U.S. Cl.

CPC ..... *E21B 34/14* (2013.01); *E21B 23/00* (2013.01); *E21B 43/103* (2013.01); *E21B 43/105* (2013.01)

(58) Field of Classification Search

CPC ..... E21B 23/00; E21B 43/103; E21B 43/105; E21B 34/14

See application file for complete search history.

(56) References Cited

U.S. PATENT DOCUMENTS

| | | | | |
|---|---|---|---|---|
| 2,315,931 A | | 4/1943 | Burt et al. | |
| 3,011,548 A | | 12/1961 | Holt | |
| 3,054,415 A | | 9/1962 | Baker et al. | |
| 3,263,752 A | | 8/1966 | Conrad | |
| 3,269,463 A | | 8/1966 | Page, Jr. | |
| 3,995,692 A | | 12/1976 | Seitz | |
| 4,064,937 A | | 12/1977 | Barrington | |
| 4,355,686 A | | 10/1982 | Arendt et al. | |
| 4,372,384 A | | 2/1983 | Kinney | |
| 4,499,951 A | | 2/1985 | Vann | |
| 4,718,488 A | * | 1/1988 | Pringle | E21B 23/02 166/135 |

(Continued)

FOREIGN PATENT DOCUMENTS

| | | | | |
|---|---|---|---|---|
| GB | 2485004 B | * | 10/2013 | E21B 23/06 |
| WO | 2003095794 | | 11/2003 | |

(Continued)

OTHER PUBLICATIONS

Lonnes, et al., "Advanced Multizone Stimulation Technology", SPE 95778—SPE Annual Technical Conference and Exhibition, Dallas, Texas, Oct. 9-12, 2005, 7 pages.

(Continued)

*Primary Examiner* — Nicole Coy

(57) ABSTRACT

A technique that is usable with a well includes deploying a segmented ring assembly in the well; and disposing the segmented ring assembly between a first element fixed in place in the well and a second unfixed element. The technique includes using the second element to compress the assembly to produce radially and tangentially acting forces on segments of the assembly.

32 Claims, 34 Drawing Sheets

(56) References Cited

U.S. PATENT DOCUMENTS 4,729,432 A 3/1988 Helms
4,771,831 A 9/1988 Pringle et al.
4,967,853 A 11/1990 Landry
5,069,280 A 12/1991 McKee et al.
5,183,114 A 2/1993 Mashaw et al.
5,224,044 A 6/1993 Tamura et al.
5,295,393 A 3/1994 Thiercelin
5,333,692 A 8/1994 Baugh et al.
5,526,888 A 6/1996 Gazewood
5,845,712 A 12/1998 Griffith
5,921,318 A 7/1999 Ross
5,988,285 A 11/1999 Tucker et al.
6,006,838 A 12/1999 Whiteley et al.
6,059,032 A 5/2000 Jones
6,155,342 A 12/2000 Oneal et al.
6,155,350 A 12/2000 Melenyzer et al.
6,206,095 B1 3/2001 Baugh
6,216,785 B1 4/2001 Achee et al.
6,220,356 B1 4/2001 Spikes
6,302,199 B1 10/2001 Hawkins et al.
6,334,486 B1 1/2002 Carmody et al.
6,349,766 B1 2/2002 Bussear et al.
6,371,208 B1 4/2002 Norman et al.
6,443,228 B1 9/2002 Aronstam et al.
6,543,538 B2 4/2003 Tolman et al.
6,634,429 B2 10/2003 Henderson et al.
6,907,936 B2 6/2005 Fehr et al.
6,997,263 B2 2/2006 Campbell et al.
7,036,582 B2 5/2006 Cook et al.
7,066,265 B2 6/2006 Surjaatmadja
7,093,664 B2 8/2006 Todd et al.
7,096,954 B2 8/2006 Weng et al.
7,108,067 B2 9/2006 Themig et al.
7,114,559 B2 10/2006 Sonnier et al.
7,128,146 B2 10/2006 Baugh et al.
7,134,505 B2 11/2006 Fehr et al.
7,168,494 B2 1/2007 Starr et al.
7,210,533 B2 5/2007 Starr et al.
7,322,417 B2 1/2008 Rytlewski et al.
7,325,617 B2 2/2008 Murray
7,350,582 B2 4/2008 McKeachnie et al.
7,353,879 B2 4/2008 Todd et al.
7,377,321 B2 5/2008 Rytlewski
7,387,165 B2 6/2008 Lopez De Cardenas et al.
7,431,091 B2 10/2008 Themig et al.
7,464,764 B2 12/2008 Xu
7,490,669 B2 2/2009 Walker et al.
7,543,634 B2 6/2009 Fehr et al.
7,543,647 B2 6/2009 Walker
7,549,469 B2 6/2009 Garcia
7,552,779 B2 6/2009 Murray
7,571,765 B2 8/2009 Themig
7,575,062 B2 8/2009 East
7,628,210 B2 12/2009 Avant et al.
7,661,481 B2 2/2010 Todd et al.
7,669,665 B2 3/2010 Millet et al.
7,673,677 B2 3/2010 King et al.
7,748,460 B2 7/2010 Themig et al.
7,775,279 B2 8/2010 Marya et al.
7,798,236 B2 9/2010 McKeachnie et al.
7,832,472 B2 11/2010 Themig
7,891,774 B2 2/2011 Silverbrook
8,211,247 B2 7/2012 Marya et al.
8,636,073 B2 * 1/2014 McNeilly ..... E21B 34/14 166/318
2003/0155118 A1 8/2003 Sonnier et al.
2003/0180094 A1 9/2003 Madison
2004/0020643 A1 2/2004 Thomeer et al.
2004/0035586 A1 2/2004 Gudmestad et al.
2004/0118564 A1 6/2004 Themig et al.
2004/0163820 A1 8/2004 Bishop et al.
2004/0262016 A1 12/2004 Farquhar
2006/0124310 A1 6/2006 Lopez De Cardenas et al.
2006/0131031 A1 6/2006 McKeachnie et al.
2006/0207764 A1 9/2006 Rytlewski
2006/0243455 A1 11/2006 Telfer et al.
2007/0044958 A1 3/2007 Rytlewski et al.
2007/0107908 A1 5/2007 Vaidya et al.
2007/0181224 A1 8/2007 Marya et al.
2007/0181304 A1 8/2007 Rankin et al.
2007/0272413 A1 11/2007 Rytlewski et al.
2007/0284097 A1 12/2007 Swor et al.
2008/0105438 A1 5/2008 Jordan et al.
2008/0210429 A1 9/2008 McMillin et al.
2009/0056934 A1 3/2009 Xu
2009/0159289 A1 * 6/2009 Avant ..... E21B 34/14 166/316
2009/0178808 A1 7/2009 Williamson et al.
2009/0255674 A1 * 10/2009 Boney ..... E21B 33/138 166/284
2010/0101803 A1 4/2010 Clayton et al.
2010/0101806 A1 4/2010 Millet et al.
2010/0132954 A1 6/2010 Telfer
2010/0209288 A1 8/2010 Marya
2010/0212886 A1 8/2010 Hall et al.
2010/0252280 A1 10/2010 Swor et al.
2010/0282469 A1 11/2010 Richard et al.
2011/0056692 A1 3/2011 Lopez De Cardenas et al.
2011/0127047 A1 6/2011 Themig et al.
2011/0186306 A1 8/2011 Marya et al.
2011/0192607 A1 8/2011 Hofman et al.
2011/0240315 A1 * 10/2011 McNeilly ..... E21B 34/14 166/386
2011/0278010 A1 11/2011 Fehr et al.
2011/0284232 A1 11/2011 Huang
2012/0067583 A1 3/2012 Zimmerman et al.
2012/0085538 A1 4/2012 Guerrero et al.
2012/0145378 A1 6/2012 Frazier
2012/0199341 A1 8/2012 Kellner et al.
2012/0227973 A1 * 9/2012 Hart ..... E21B 21/103 166/329
2012/0261115 A1 * 10/2012 Xu ..... E21B 34/14 166/193
2012/0305236 A1 12/2012 Gouthaman
2013/0062063 A1 3/2013 Baihly et al.
2013/0233564 A1 9/2013 Pacey et al.
2014/0014371 A1 1/2014 Jacob et al.
2014/0060837 A1 * 3/2014 Love ..... E21B 43/26 166/297
2014/0202708 A1 7/2014 Jacob et al.
2014/0216758 A1 8/2014 Jacob et al.
2014/0216759 A1 8/2014 Jacob et al.

FOREIGN PATENT DOCUMENTS

WO 2004088091 A1 10/2004
WO 2009023519 A1 2/2009
WO 2011006173 A2 1/2011
WO 2012174101 A2 12/2012

OTHER PUBLICATIONS

Rytlewski, "Multiple-Layer Completions for Efficient Treatment of Multi-layer Reservoirs", SPE 112476—IADC/SPE Drilling Conference, Orlando, Florida, USA, Mar. 4-6, 2008, 8 pages.

Thomson, et al., "Design and Installation of a Cost-Effective Completion System for Horizontal Chalk Wells Where Multiple Zones Require Acid Stimulation", SPE 51177 (a revision of SPE 39150), Offshore Technology Conference, Houston, TX, USA, May 1997, pp. 97-108.

Australian Examination Report for corresponding Australian Application Serial No. 2014332469, dated Sep. 13, 2017, 3 pages.

Australian Examination Report for related Australian Application Serial No. 2014349004, dated Aug. 11, 2017, 5 pages.

Australian Examination Report for related Australian Application Serial No. 2014212753, dated Apr. 4, 2017, 3 pages.

Examination Report for related GCC Application Serial No. 2014-26329, dated Oct. 22, 2017, 5 pages.

Examination Report for related GCC Application Serial No. 2014-26330, dated May 5, 2017, 5 pages.

(56) References Cited

OTHER PUBLICATIONS

Non-Final Office Action for related U.S. Appl. No. 14/029,958, dated Jan. 12, 2018, 15 pages.
Exam Report issued in corresponding GC Patent Application No. P/2014/28322 dated Feb. 26, 2018, 4 pages.

* cited by examiner

SEGMENTED RING ASSEMBLY

CROSS-REFERENCE TO RELATED APPLICATIONS

This application is a Continuation-in-Part of, and claims priority to, U.S. patent application Ser. No. 14/029,936, filed Sep. 18, 2013, titled "DEPLOYING AN EXPANDABLE DOWNHOLE SEAT ASSEMBLY". Additionally, this application claims priority to U.S. Provisional Pat. Application No. 61/905,328, filed Nov. 18, 2013, and titled, "METHOD AND APPARATUS FOR SEALING INSIDE A CYLINDRICAL TUBE USING CONICAL SEGMENTED RING." Both are incorporated herein by reference in their entireties and for all purposes.

BACKGROUND

For purposes of preparing a well for the production of oil or gas, at least one perforating gun may be deployed into the well via a conveyance mechanism, such as a wireline, slickline or a coiled tubing string. The shaped charges of the perforating gun(s) are fired when the gun(s) are appropriately positioned to perforate a casing of the well and form perforating tunnels into the surrounding formation. Additional operations may be performed in the well to increase the well's permeability, such as well stimulation operations and operations that involve hydraulic fracturing. The above-described perforating and stimulation operations may be performed in multiple stages of the well.

The above-described operations may be performed by actuating one or more downhole tools (perforating guns, sleeve valves, and so forth). A given downhole tool may be actuated using a wide variety of techniques, such dropping a ball into the well sized for a seat of the tool; running another tool into the well on a conveyance mechanism to mechanically shift or inductively communicate with the tool to be actuated; pressurizing a control line; and so forth.

SUMMARY

In an example implementation, a technique that is usable with a well includes deploying a segmented ring assembly in the well; and disposing the segmented ring assembly between a first element fixed in place in the well and a second unfixed element. The technique includes using the second element to compress the assembly to produce radially and tangentially acting forces on segments of the assembly.

In another example implementation, an apparatus that is usable with a well includes arcuate-shaped segments. The segments are adapted to form a ring downhole in the well; and the segments are adapted to, in response to being compressed between two elements in the well, produce radial and tangentially acting forces to form metal-to-metal fluid seals between the segments.

In yet another example implementation, a system that is usable with a well includes a segmented ring assembly and an object. The segmented ring assembly includes arcuate-shaped segments; and the segments are adapted to form a ring downhole in the well. The segments are further adapted to, in response to being compressed, produce radially acting and tangentially acting forces to form metal-to-metal fluid seals between edges of the segments and radially expand the segments. The object compresses the assembly to produce the radially acting and tangentially acting forces.

Advantages and other features will become apparent from the following drawing, description and claims.

DETAILED DESCRIPTION

Figure 1:
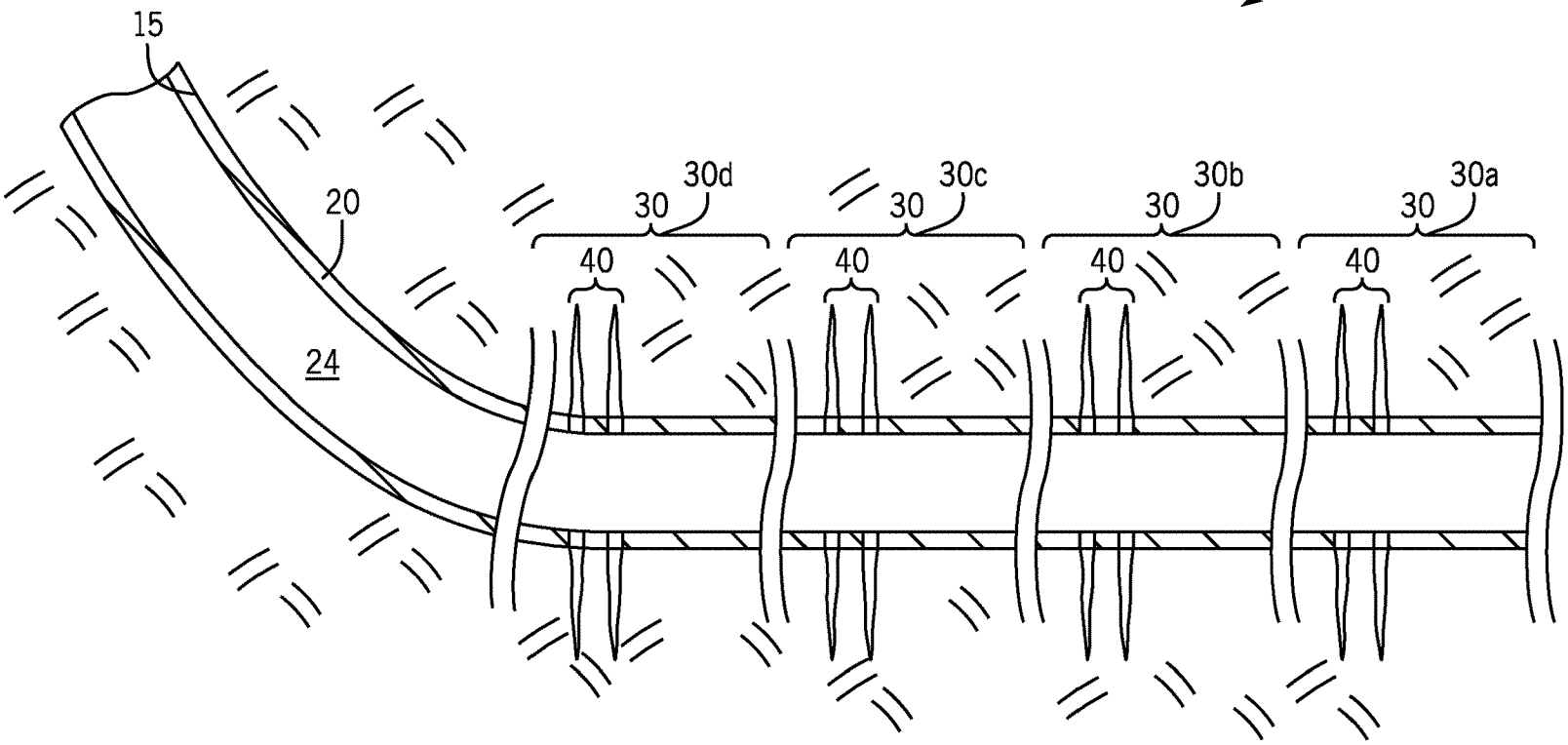
FIGS. 1 and 2 are schematic diagrams of wells according to example implementations.

In general, systems and techniques are disclosed herein to deploy and use a segmented ring assembly in a well for purposes of performing a downhole operation. As an example, the ring assembly may be run downhole in the well and secured to a tubular member (a casing string, a deformable tubular member, a fracturing sleeve valve, a tubing inside an open hole completion, and so forth, as examples) at a desired location in which the downhole operation is to be performed. The downhole operation may be any of a number of operations (stimulation operations, perforating operations, and so forth) that use a ring, or seat, for purposes of receiving a member (an activation ball, a dart, a bar, a tool surface, and so forth) to form a fluid barrier in the well.

In general, the segmented ring assembly is an expandable, segmented assembly, which is formed from arcuate segments. The segmented ring assembly has two states: a collapsed, or unexpanded state, which allows the ring assembly to have a smaller cross-section for purposes of running the assembly downhole; and an expanded state in which the ring assembly forms a continuously extending ring that is constructed to receive an object to form the downhole fluid barrier.

In accordance with example implementations, the segmented ring assembly is constructed to form a ring to receive, or catch, an untethered object, which is deployed in the well. In this context, an "untethered object" refers to an object that is communicated downhole through a passageway (a tubing string passageway, for example) of the well along at least part of its path without the use of a conveyance line (a slickline, a wireline, a coiled tubing string and so forth). As examples, the untethered object may be a ball (or sphere), a dart or a bar. The untethered object may also be a tool that is pumped downhole.

In accordance with further example implementations, the ring formed by the segmented ring assembly may be engaged by a profiled surface of a downhole tool for purposes of forming a fluid barrier. In this regard, a given tool may contain a profiled surface on the end of the tool or at another location of the tool (an annular ring that extends around the tool and is axially disposed between ends of the tool, for example). The tool may be conveyed downhole (via a wireline, slickline, coiled tubing, and so forth, as examples) and moved into position to engage the ring assembly, as described herein.

In general, in accordance with example implementations, the segmented ring assembly is constructed to be disposed between a first element of the well, which is fixed in place (relative to the downhole completion) and a second element for purposes of allowing the first and second elements to axially compress the assembly. In this manner, the first element may be, as examples, a tubular member, such as a casing string, deformable tubing or fracturing valve. The second element may be, as examples, an untethered object or a tethered object (an object run downhole via a conveyance line-deployed tool or a tractor, as just a few examples). Moreover, the second element may be formed from part of a tool (a fracturing valve, for example), which is used to perform a downhole function in addition to forming a fluid barrier.

The ring assembly is constructed to direct the compressive forces that are applied by the first and second elements into corresponding radially acting and tangential acting forces to 1.) radially expand the segments of the ring assembly into engagement with the first element and form a metal-to-metal seal with the first element; 2.) form a metal-to-metal seal between the ring assembly and the second element; and 3.) form metal-to-metal fluid seals between adjacent and contacting segments of the ring assembly.

Referring to FIG. 1, as a more specific example, in accordance with some implementations, a well 10 includes a wellbore 15, which traverses one or more hydrocarbonbearing formations. As an example, the wellbore 15 may be lined, or supported, by a tubing string 20, as depicted in FIG. 1. The tubing string 20 may be cemented to the wellbore 15 (such wellbores are typically referred to as "cased hole" wellbores); or the tubing string 20 may be secured to the surrounding formation(s) by packers (such wellbores typically are referred to as "open hole" wellbores). In general, the wellbore 15 may extend through multiple zones, or stages 30 (four example stages 30*a*, 30*b*, 30*c* and 30*d*, being depicted in FIG. 1, as examples), of the well 10.

It is noted that although FIG. 1 and other figures disclosed herein depict a lateral wellbore, the techniques and systems that are disclosed herein may likewise be applied to vertical wellbores. Moreover, in accordance with some implementations, the well 10 may contain multiple wellbores, which contain tubing strings that are similar to the illustrated tubing string 20 of FIG. 1. The well 10 may be a subsea well or may be a terrestrial well, depending on the particular implementations. Additionally, the well 10 may be an injection well or may be a production well. Thus, many implementations are contemplated, which are within the scope of the appended claims.

The downhole operations may be performed in the stages 30 in a particular directional order, in accordance with example implementations. For example, in accordance with some implementations, downhole operations may be conducted in a direction from a toe end of the wellbore to a heel end of the wellbore 15. In further implementations, these downhole operations may be connected from the heel end to the toe end of the wellbore 15. In accordance with further example implementations, the operations may be performed in no particular order, or sequence.

FIG. 1 depicts that fluid communication with the surrounding hydrocarbon formation(s) has been enhanced through sets 40 of perforation tunnels that, for this example, are formed in each stage 30 and extend through the tubing string 20. It is noted that each stage 30 may have multiple sets of such perforation tunnels 40. Although perforation tunnels 40 are depicted in FIG. 1, it is understood that other techniques may be used to establish/enhance fluid communication with the surrounding formation (s), as the fluid communication may be established using, for example, a jetting tool that communicates an abrasive slurry to perforate the tubing string wall; opening sleeve valves of the tubing string 20; and so forth.

Figure 2:
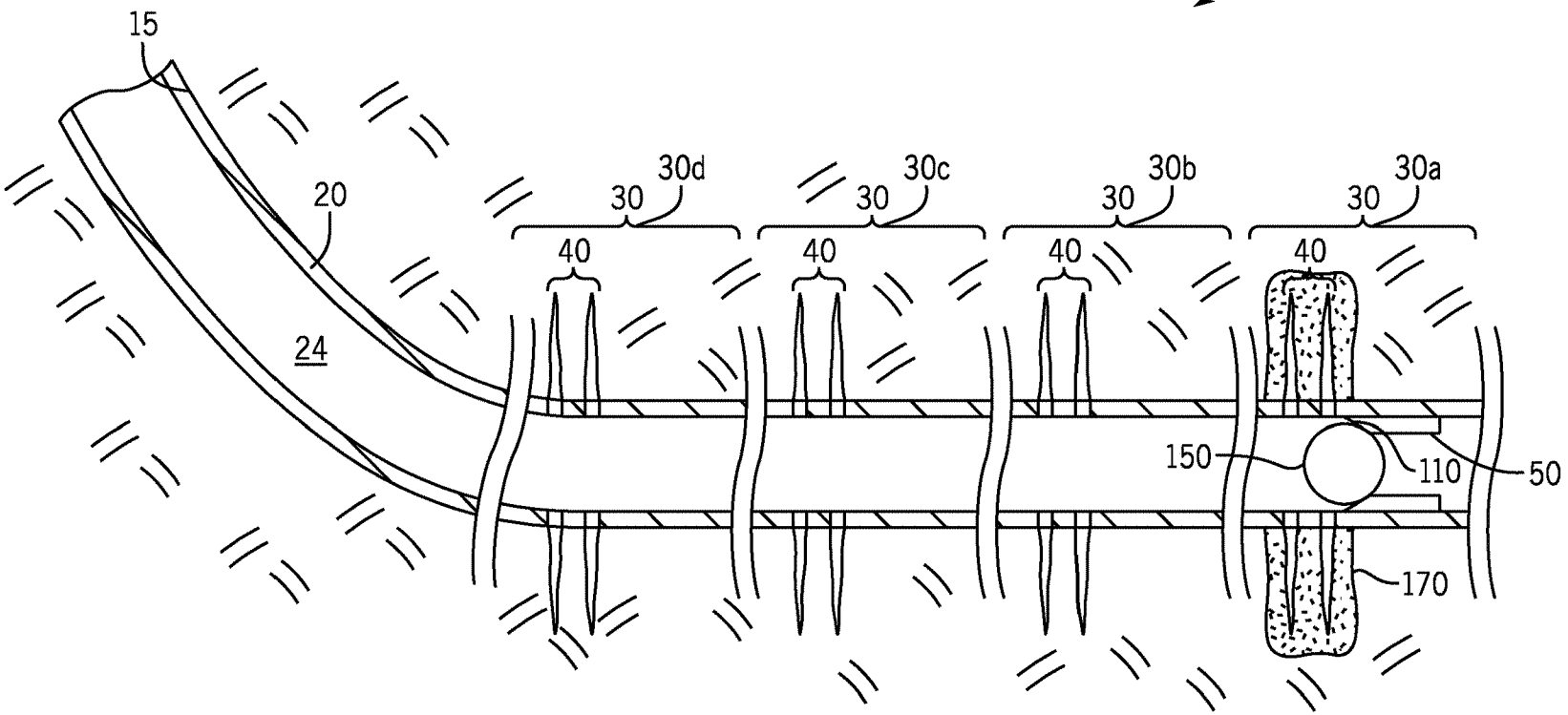

Referring to FIG. 2 in conjunction with FIG. 1, as an example, a stimulation operation may be performed in the stage 30*a* by deploying an expandable, segmented ring assembly 50 (herein called the "ring assembly") into the tubing string 20 on a setting tool (as further disclosed herein) in a contracted state of the assembly 50; expanding the ring assembly 50 downhole in the well; and securing the ring assembly 50 to the tubing string 20 at a targeted location in the stage 30*a*. For the example implementation that is depicted in FIG. 2, the ring assembly 50 is installed in the tubing string 20 near the bottom, or downhole end, of the stage 30*a*. Once installed inside the tubing string 20, the combination of the ring assembly 50 and an untethered object (here, an activation ball 150) form a fluid tight obstruction, or barrier, to divert fluid in the tubing string 20 uphole of the barrier. Thus, for the example implementation of FIG. 2, the fluid barrier may be used to direct fracture fluid (pumped into the tubing string 20 from the Earth surface) into the stage 30*a*.

Figure 3A:
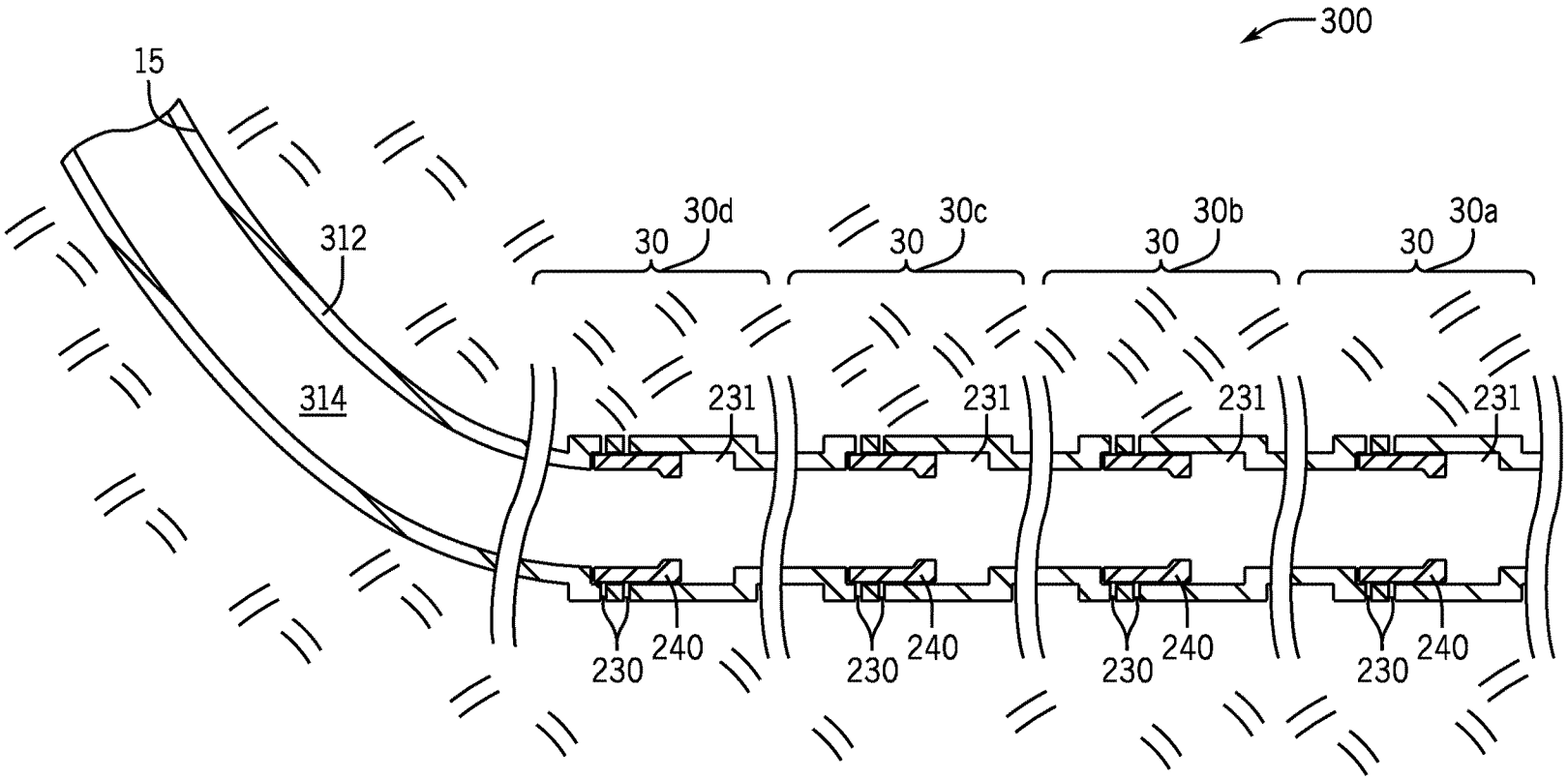
FIGS. 3A, 3B, 3C, 3D and 3E are schematic diagrams of a well illustrating use of an expandable, segmented ring assembly to operate a sleeve valve according to an example implementation.

FIG. 3A depicts an example tubing string 312 of a well 300, which has a central passageway 314 and extends through associated stages 30*a*, 30*b*, 30*c* and 30*d* of the well 300. Each stage 30 has an associated sleeve 240, which resides in a recess 231 of the tubing string 312 and has been previously installed in the stage 30. For the state of the well 300 depicted in FIG. 3A, the sleeve 240 is installed in the well in a closed state, or an uphill position and therefore covers radial ports 230 in the tubing string wall. As an example, each stage 30 may be associated with a given set of radial ports 230, so that by communicating an activation ball (or other untethered object) downhole inside the passageway 314 of the tubing string 312 and landing the ball in a seat of a ring assembly 237 (see FIG. 3B), a corresponding fluid barrier may be formed to divert fluid through the associate set of radial ports 230.

Figure 3B:
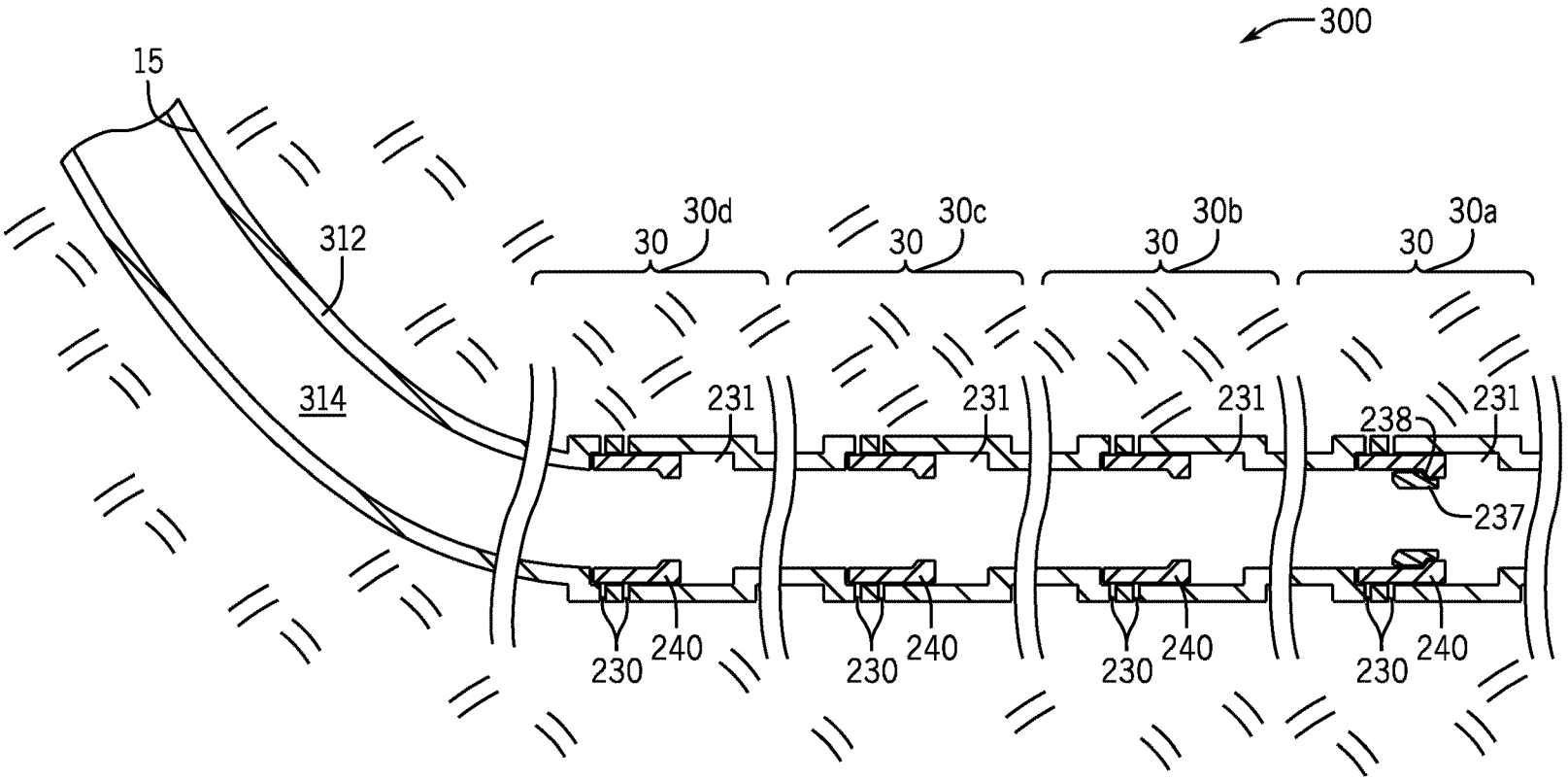

Referring to FIG. 3B, as shown, the ring assembly 237 has been deployed (attached, anchored, swaged) to the sleeve 240. The connection between the ring assembly 237 and the sleeve 240 may be facilitated using a shoulder 238 on the sleeve 240, which engages a corresponding shoulder of the ring assembly 237. However, in accordance with further implementations, other connection methods may be used, such as recess on the sleeve 240, a direct anchoring with the ring assembly 237, and so forth.

It is noted that the ring assemblies 237 may be installed one by one after the stimulation of each stage 30 (as discussed further below); or multiple ring assemblies 237 may be installed in a single trip into the well 300. Therefore, the seat, or inner catching diameter of the ring assembly 237, for the different assemblies 237, may have different dimensions, such as inner dimensions that are relatively smaller downhole and progressively become larger moving in an uphill direction. This allows the use of differently-sized activation balls to land on the ring assemblies 237 without further downhole intervention and therefore achieve continuous pumping treatment of multiple stages 30.

Figure 3C:
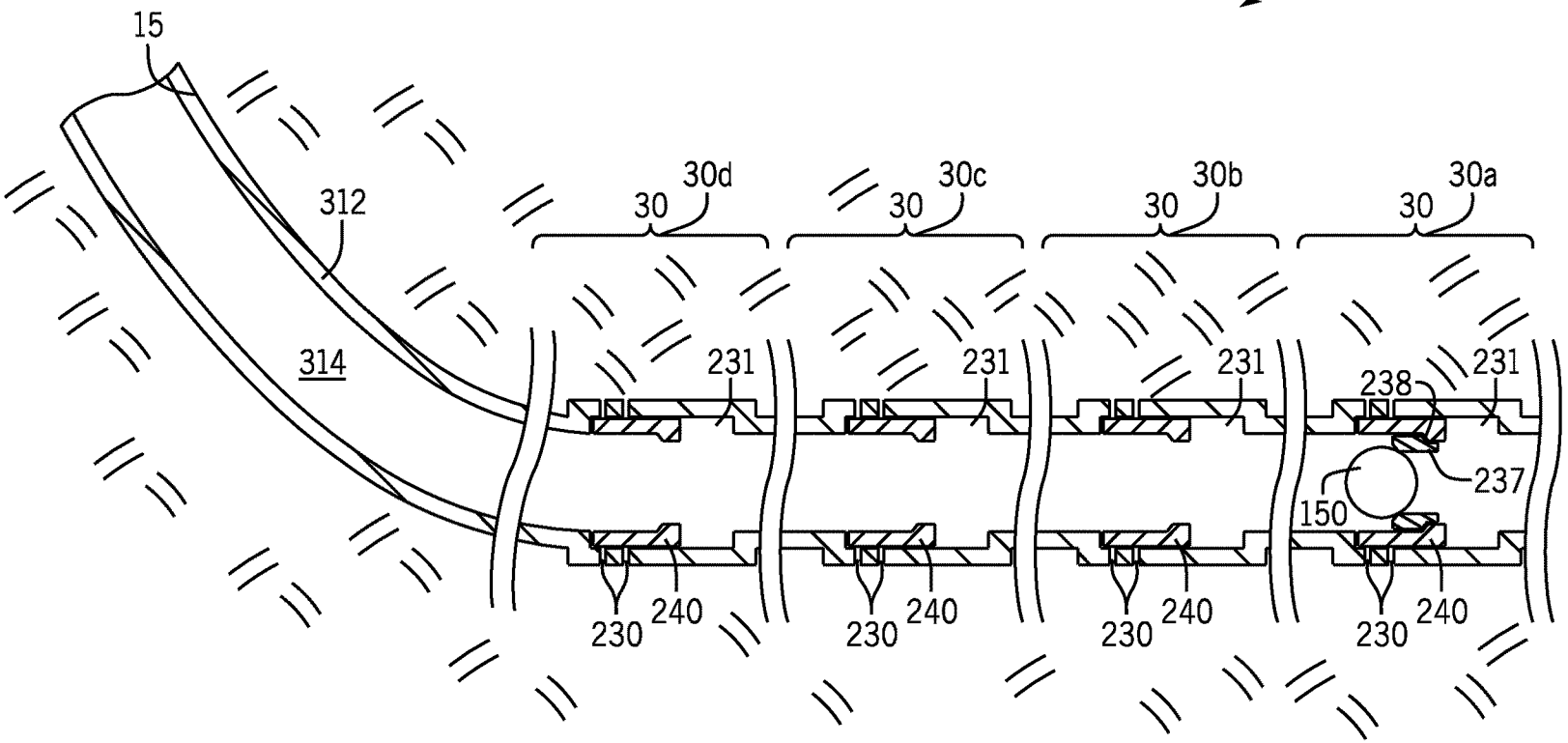

Referring to FIG. 3C, this figure depicts the landing of the activation ball 150 on the ring assembly 237 of the stage 30*a*. Thus, at this point, the activation ball 150 has been retained, or caught, by the ring assembly 237.

Figure 3D:
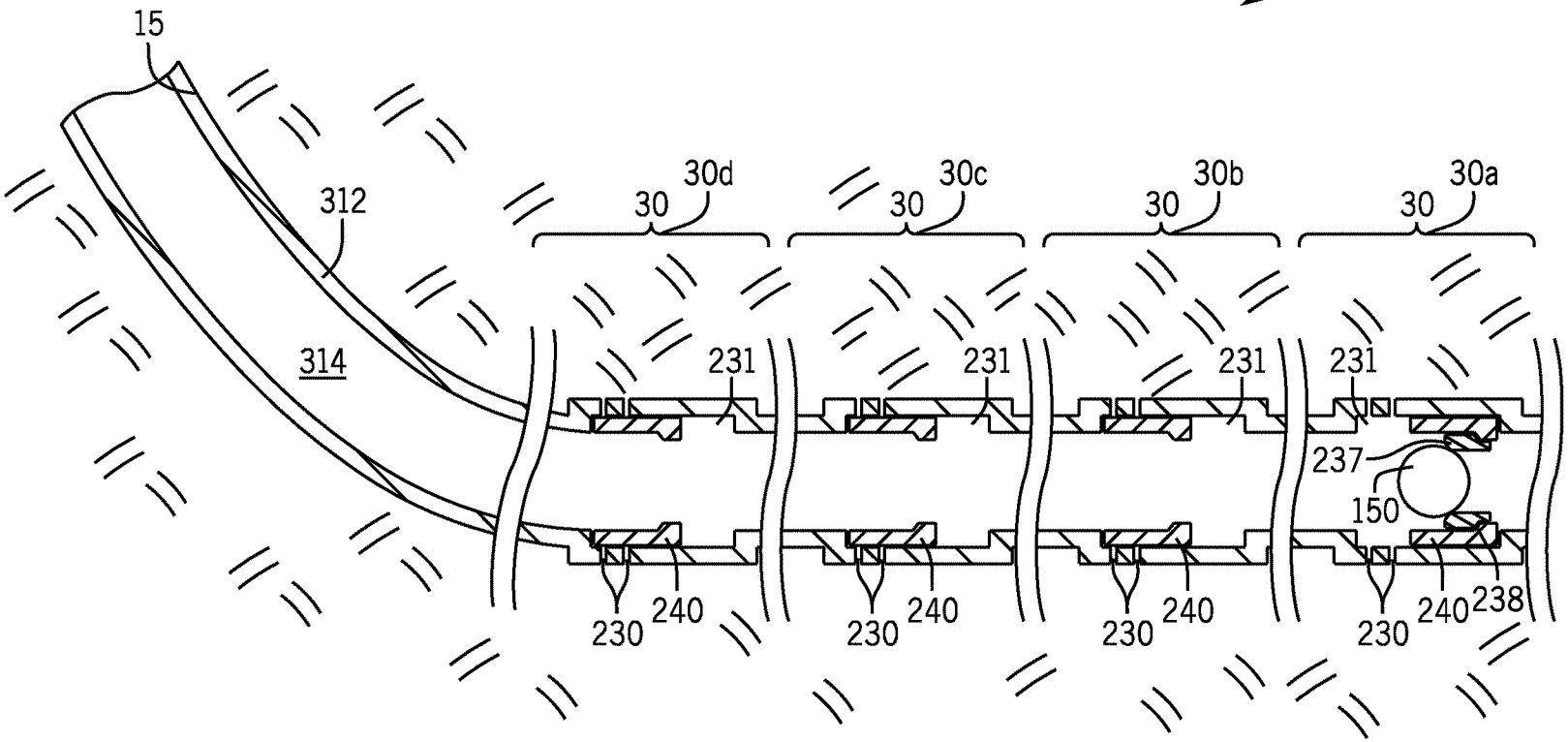

Referring to FIG. 3D, due to the force that is exerted by the activation ball 150, due to either through the momentum of the ball 150 or the pressure differential created by the ball 150, the sleeve 240 as well as the ring assembly 237 is shifted downhole, revealing the radial ports 230. In this position, a pumping treatment (the pumping of a fracturing fluid, for example) may be performed in the stage 30*a*.

Figure 3E:
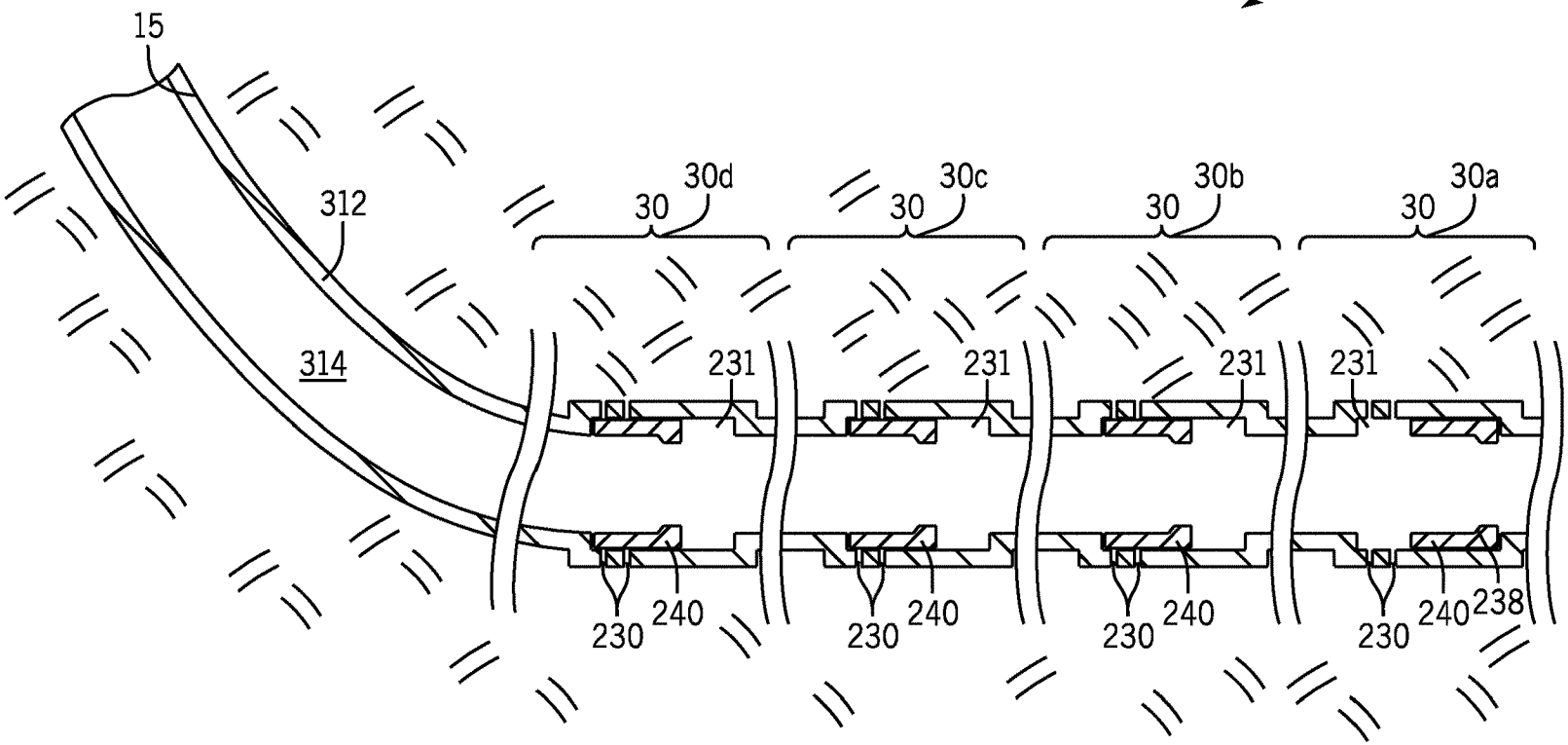

FIG. 3E depicts the stage 30*a* with the sleeve 240 in the opened position and with the ring assembly 237 and activation ball 150 being dissolved, as further discussed below.

Figure 4:
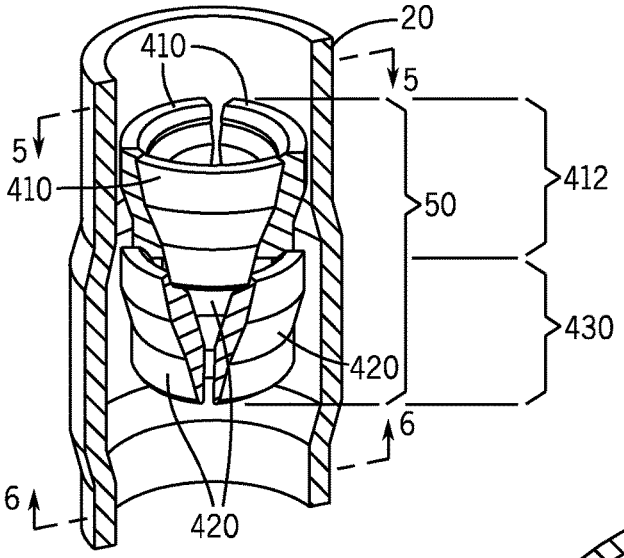
FIG. 4 is a schematic view illustrating an expandable, segmented ring assembly in a contracted state and inside a tubing string according to an example implementation.
Figure 5:
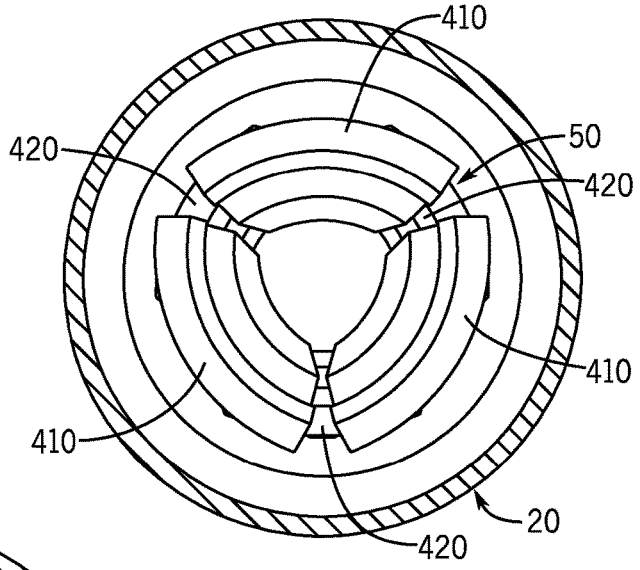
FIG. 5 is a cross-sectional view taken along line 5-5 of FIG. 4 according to an example implementation.
Figure 6:
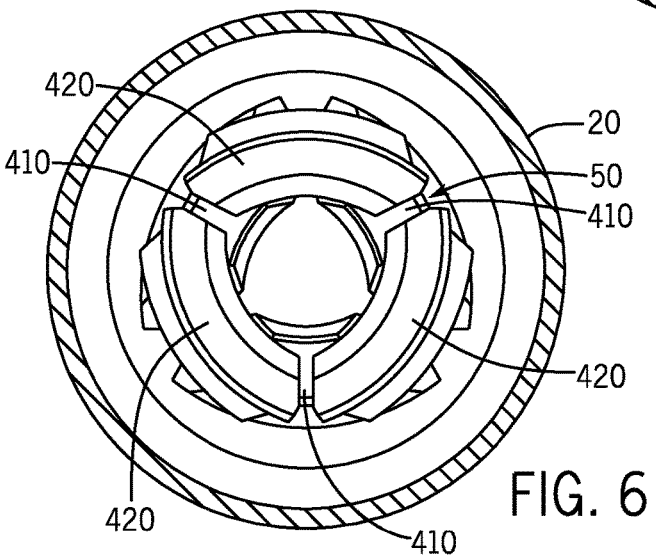
FIG. 6 is a cross-sectional view taken along line 6-6 of FIG. 4 according to an example implementation.

As an example, FIG. 4 is a perspective of the ring assembly 50, and FIGS. 5 and 6 illustrate cross-sectional views of the ring assembly 50 of FIG. 4, in accordance with an example implementation. Referring to FIG. 4, this figure depicts the ring assembly 50 in a contracted state, i.e., in a radially collapsed state, which facilitates travel of the ring assembly 50 downhole to its final position. The ring assembly, 50 for this example implementation, has two sets of arcuate segments: three upper segments 410; and three lower segments 420. In the contracted state, the segments 410 and 420 are radially contracted and are longitudinally, or axially, expanded into two layers 412 and 430.

Figure 7:
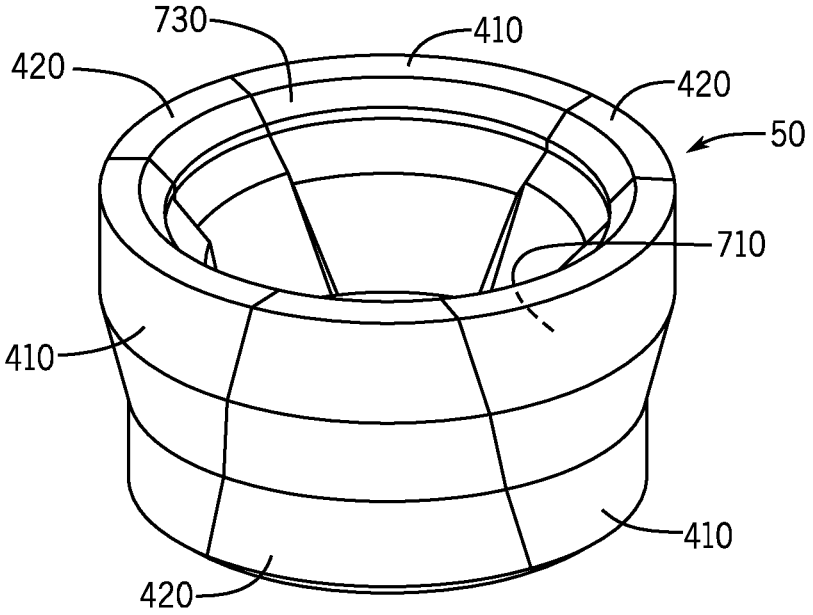
FIG. 7 is a perspective view of the ring assembly in an expanded state according to an example implementation.

The upper segment 410 is, in general, a curved wedge that has a radius of curvature about the longitudinal axis of the ring assembly 50 and is larger at its top end than at its bottom end; and the lower segment 420 is, in general, an arcuate wedge that has the same radius of curvature about the longitudinal axis (as the upper segment) and is larger at its bottom end than at its top end. Due to the relative complementary profiles of the segments 410 and 420, when the ring assembly 50 expands (i.e., when the segments 410 and 420 radially expand and the segments 410 and 420 axially contract), the two layers 412 and 430 longitudinally, or axially, compress into a single layer of segments such that each upper segment 410 is complimentarily received between two lower segments 420, and vice versa, as depicted in FIG. 7. In its expanded state, the ring assembly 50 forms a tubular member having a seat that is sized to catch an appropriately-sized object that is deployed in the tubing string 20 for purposes of forming a fluid barrier.

Figure 8:
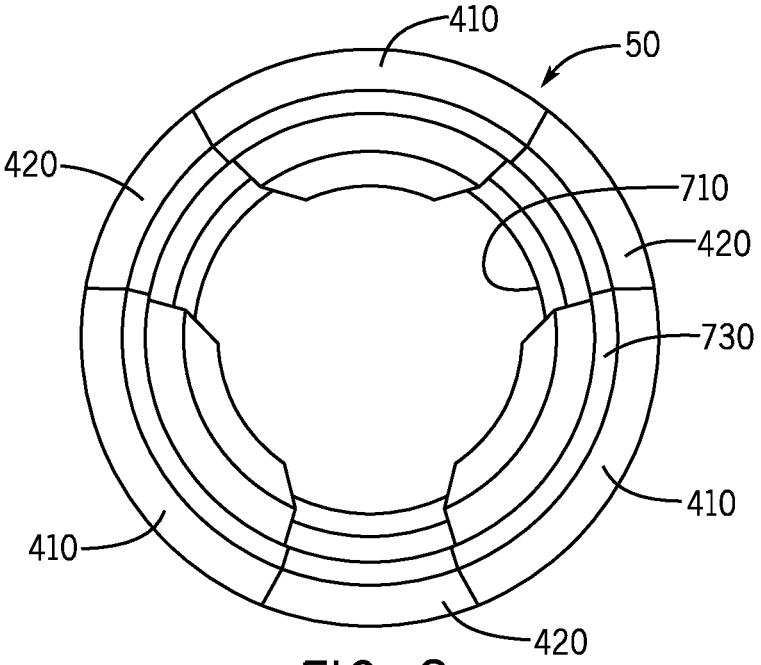
FIG. 8 is a top view of the ring assembly of FIG. 7 according to an example implementation.

More specifically, an upper curved surface of each of the segments 410 and 420 forms a corresponding section of a seat ring 730 (i.e., the "seat") of the ring assembly 50 when the assembly 50 is in its expanded state. As depicted in FIG. 8, in its expanded state, the seat ring 730 of the ring assembly 50 defines an opening 710, which is appropriately sized to control which smaller size objects to pass through the seat ring 730 and which larger size objects are caught by the seat ring 730.

Figure 9:
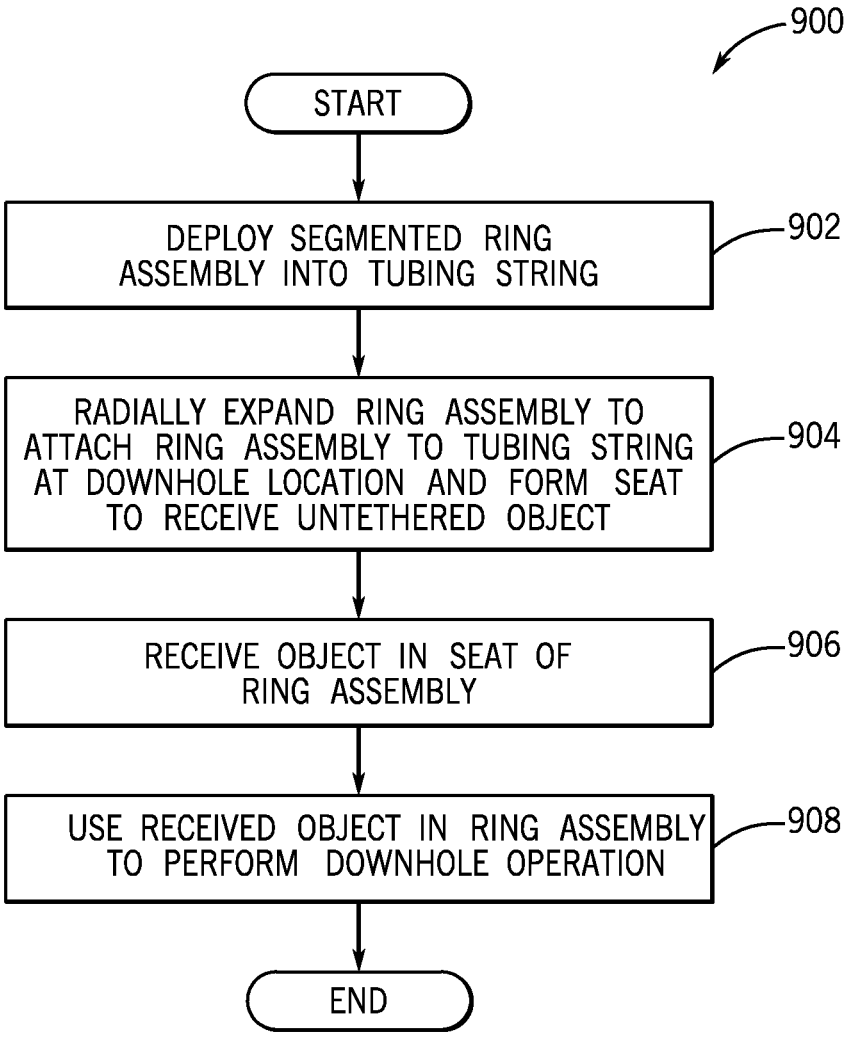
FIG. 9 is a flow diagram depicting a technique to deploy and use an expandable ring assembly according to an example implementation.

Thus, referring to FIG. 9, in accordance with example, implementations, a technique 900 includes deploying (block 902) a segmented ring assembly into a tubing string and radially expanding (block 904) the ring assembly to attach the ring assembly to a tubing string at a downhole location and form a seat to receive an untethered object. Pursuant to the technique 900, an object is received in a seat of the ring assembly and used (block 908) to perform a downhole operation.

Figure 10:
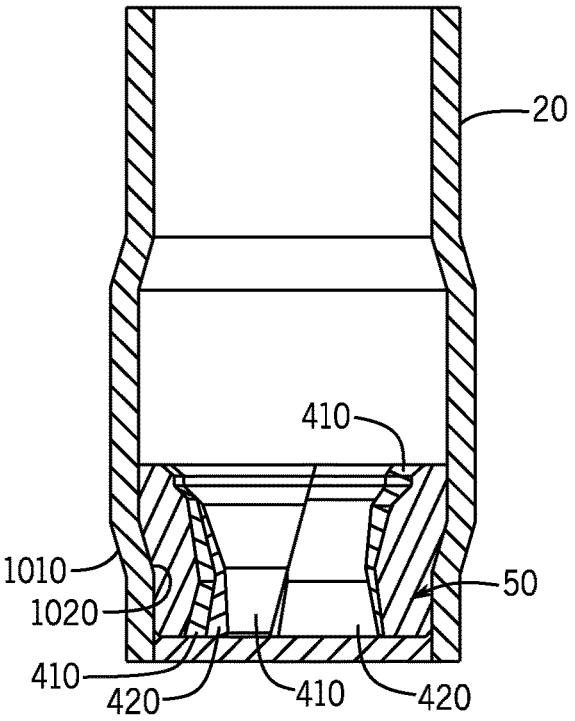
FIG. 10 is a cross-sectional view of the ring assembly in an expanded state inside a tubing string according to an example implementation.

The ring assembly 50 may attach to the tubing string in numerous different ways, depending on the particular implementation. For example, FIG. 10 depicts an example tubing string 20 that contains a narrowed seat profile 1020, which complements an outer profile of the ring assembly 50 in its expanded state. In this regard, as depicted in FIG. 10, the segments 410 and 420 contain corresponding outer profiles 1010 that engage the tubing profile 1010 to catch the ring assembly 50 on the profile 1020. In accordance with example implementations, at its profile 1020, the tubing string 50 has a sufficiently small cross-section, or diameter for purposes of forming frictional contact to allow the setting tool to transition the ring assembly 50 to the expanded state, as further disclosed herein.

Figure 11:
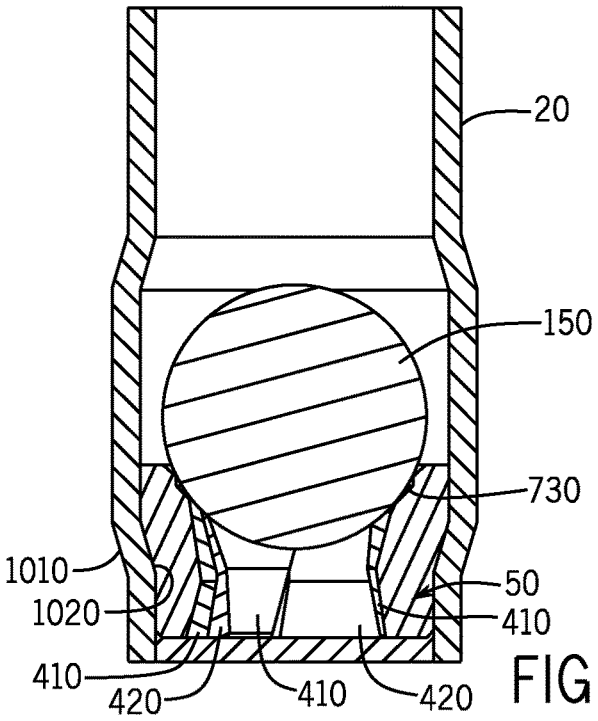
FIG. 11 is a cross-sectional view of the ring assembly in an expanded state inside a tubing string and in receipt of an activation ball according to an example implementation.

Moreover, in accordance with example implementations, the full radial expansion and actual contraction of the ring assembly 50 may be enhanced by the reception of the untethered object 150. As shown in FIG. 11, the untethered object 150 has a diameter that is sized appropriately to land in the seat ring 730 and further expand the ring assembly 50.

Further systems and techniques to run the ring assembly 50 downhole and secure the ring assembly 50 in place downhole are further discussed below.

Figure 12:
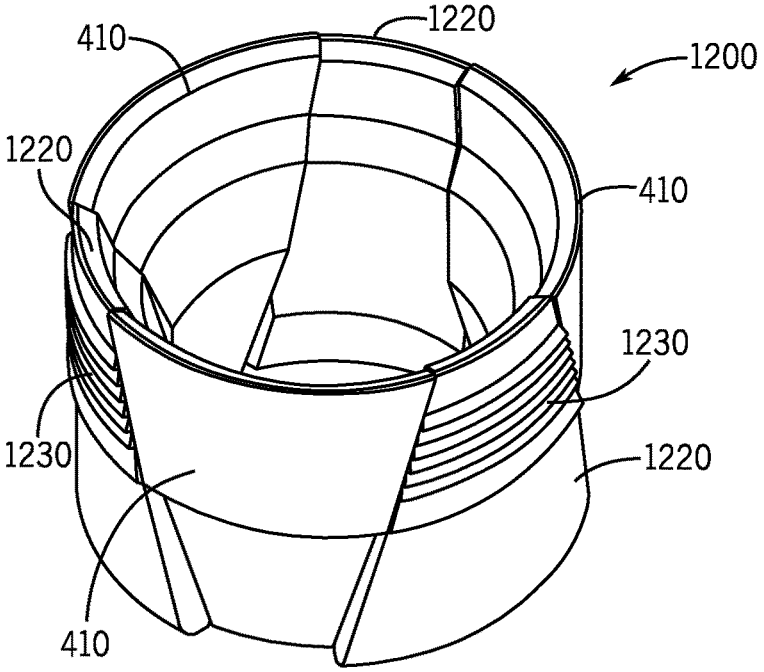
FIGS. 12 and 13 are perspective views of expandable ring assemblies according to further example implementations.
Figure 13:
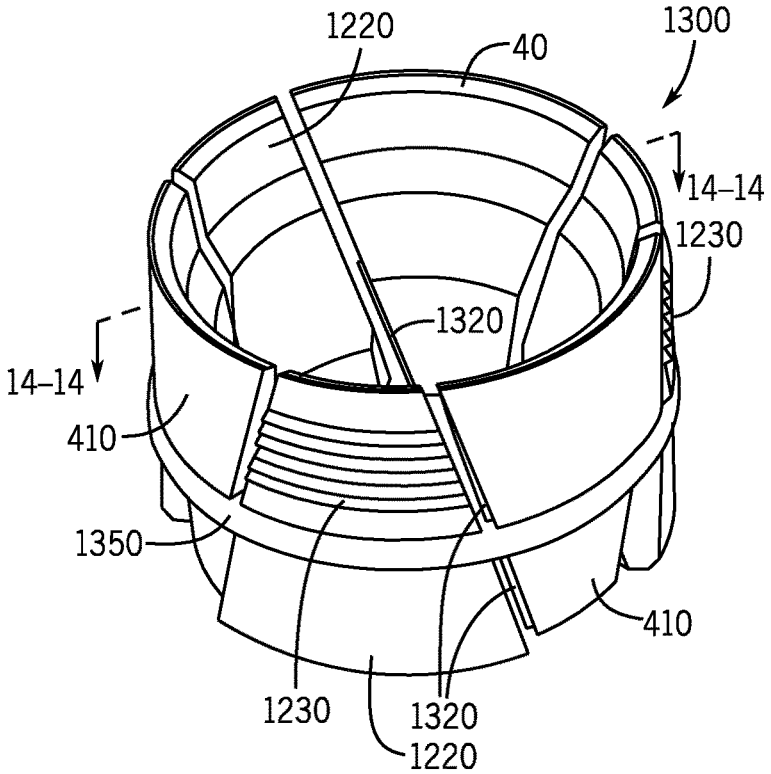

FIG. 12 depicts a ring assembly 1200 that has similar elements to the ring assembly 50, with similar reference numerals being used to depict similar elements. Unlike the ring assembly 50, the ring assembly 1200 has segments 1220 that replace the segments 420. The segments 1220 are, in general, arcuate and wedge-shaped sections similar to the segments 420. However, unlike the segments 420, the segments 1220 have anchors, or slips 1230, that are disposed on the outer surface of the segments 1220 for purposes of anchoring the ring assembly 1200 to the tubing string wall when the segments 1220 radially expand. As another example, FIG. 13 depicts a ring assembly 1300 that that has similar elements to the ring assembly 1200, with similar reference numerals being used to depict similar elements.

Figure 14:
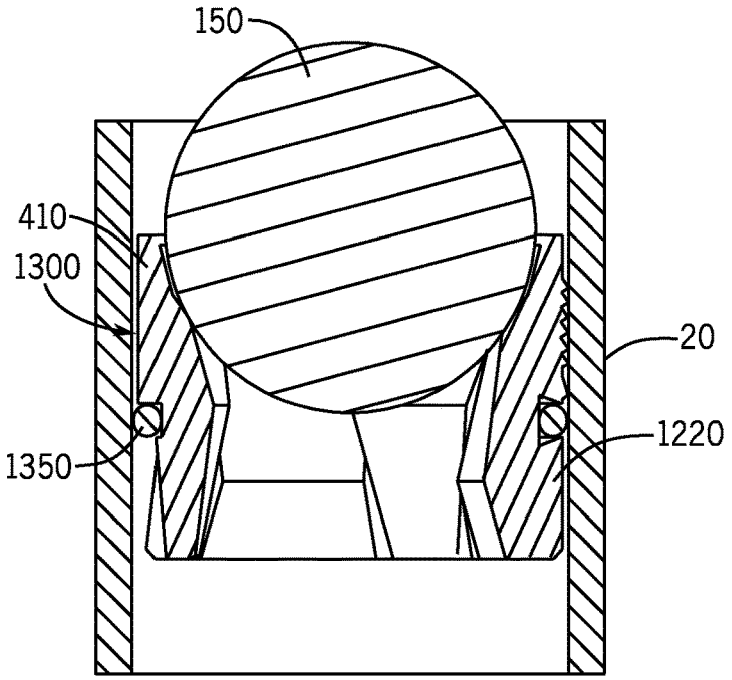
FIG. 14 is a cross-sectional view of the ring assembly taken along line 14-14 of FIG. 13 when the ring assembly is in receipt of an activation ball according to an example implementation.

Unlike the ring assembly 1200, the ring assembly 1300 contains fluid seals. In this manner, in accordance with example implementations, the ring assembly 1300 has fluid seal elements 1320 (elastomer material-based seal elements, for example) that are disposed between the axially extending edges of the segments 410 and 1220. Moreover, the ring assembly 1300 includes a peripherally extending seal element 1350 (an o-ring, for example), which extends about the periphery of the segments 410 and 1220 to form a fluid seal between the outer surface of the expanded ring assembly 1300 and the inner surface of the tubing string wall. More specifically, FIG. 14 depicts a cross-sectional view of the ring assembly 1300 of FIG. 13 in the radially expanded state when receiving an untethered object 150.

In accordance with some implementations, the collective outer profile of the segments 410 and 420 may be contoured in a manner to form an object that engages a ring assembly that is disposed further downhole. In this manner, after the ring assembly performs its intended function by catching an untethered object, the ring assembly may then be transitioned (via a downhole tool, for example) back into its radially contracted state so that the ring assembly may travel further downhole and serves as an untethered object to perform another downhole operation.

As a more specific example, in accordance with further implementations, a segmented ring assembly 2700 of FIG. 27 may be used. In general, the segmented ring assembly 2700 has upper seat segments 410 and lower seat segments 420, similar to the seat segments discussed above. The segmented ring assembly 2700 includes a lower contoured cap 2710, which is profiled (having, for example, beveled features, as depicted at reference number 2714) for purposes of forming a contoured profile to engage a seat that is positioned below the segmented ring assembly 2700 after the segmented ring assembly 2700 is released. As an example, in accordance with some implementations, the cap 2710 may be attached to the lower seat segments 420.

Figure 15:
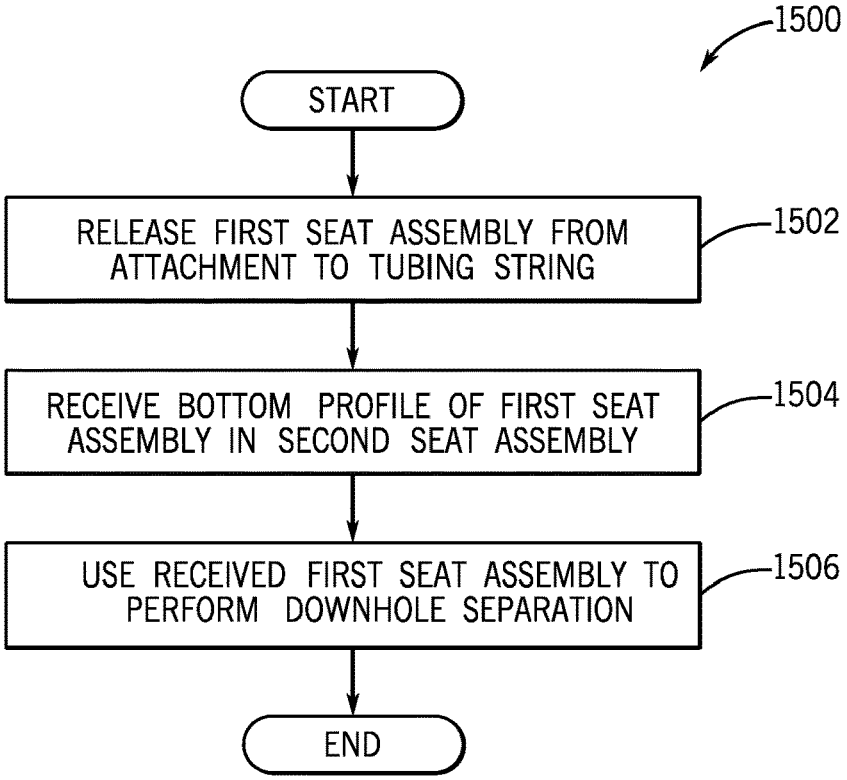
FIG. 15 is a flow diagram depicting a technique to deploy and use an expandable ring assembly according to a further example implementation.

Thus, referring to FIG. 15, in accordance with an example implementation, a technique 1500 includes releasing (block 1502) a first ring assembly from being attached to a tubing string and receiving (block 1504) a bottom profile of the first ring assembly in a second ring assembly. Pursuant to the technique 1500, the received first ring assembly may then be used, pursuant to block 1506, to perform a downhole operation.

Figure 16A:
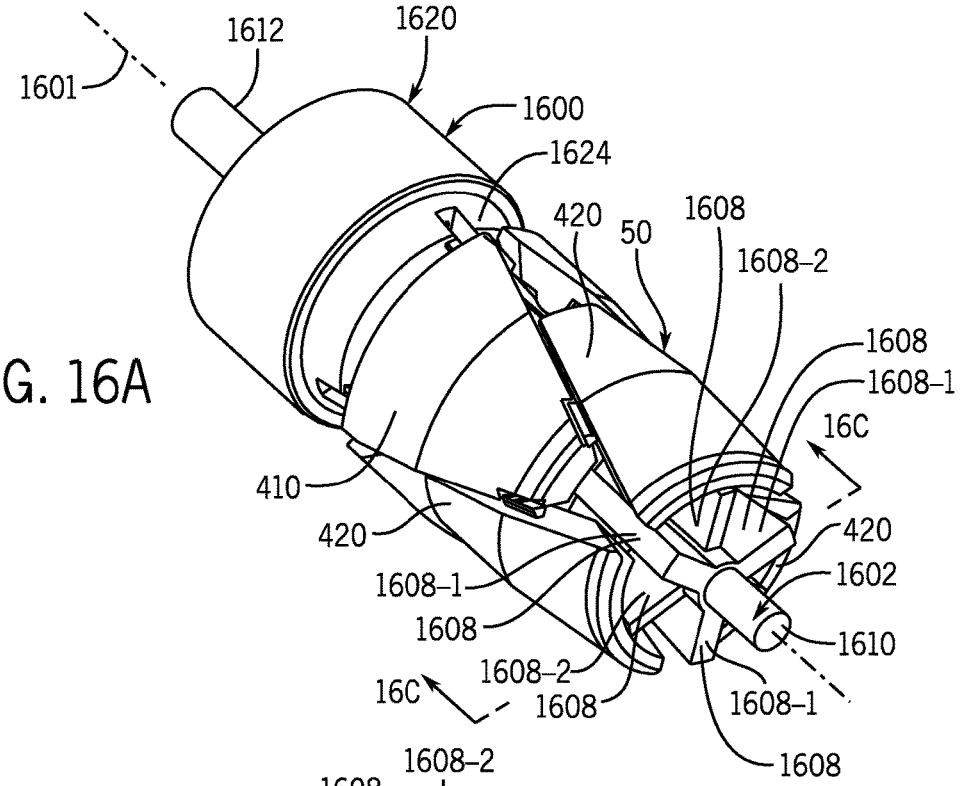
FIG. 16A is a perspective view of a ring assembly setting tool and a segmented ring assembly according to an example implementation.

Referring to FIG. 16A, in accordance with an example implementation, a setting tool 1600 may be used to transition the ring assembly 50 between its contracted and expanded states. As further disclosed herein, the setting tool 1600 includes components that move relative to each other to expand or contract the ring assembly 50: a rod 1602 and a mandrel 1620, which generally circumscribes the rod 1602. The relative motion between the rod 1602 and the mandrel 1620 causes surfaces of the mandrel 1620 and rod 1602 to contact the upper 410 and lower 420 segments of the ring assembly 50 for purposes of radially expanding the segments 410 and 420 and longitudinally contracting the segments into a single layer to form the continuous seat, as described above.

As depicted in FIG. 16A, the rod 1602 and mandrel 1620 are generally concentric with a longitudinal axis 1601 and extend along the longitudinal axis 1601. An upper end 1612 of the rod 1602 may be attached to a conveyance line (a coiled tubing string, for example), and a bottom end 1610 of the rod 1602 may be free or attached to a downhole tool or string, depending on the particular implementation.

Figure 16B:
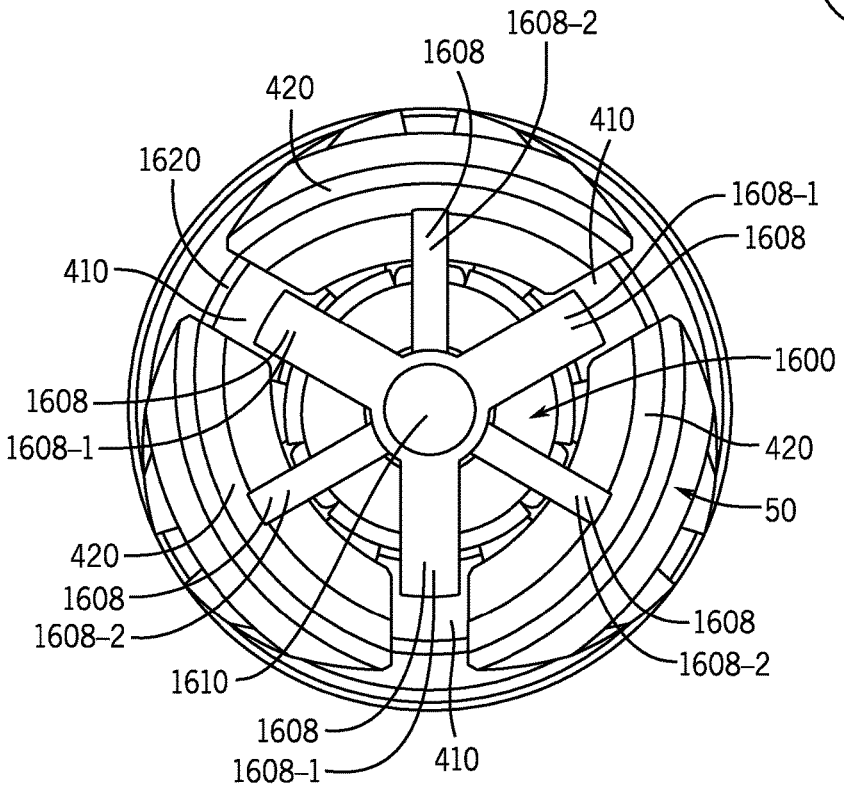
FIG. 16B is a bottom view of the ring assembly setting tool and ring assembly of FIG. 16A according to an example implementation.

Referring to FIG. 16B in conjunction with FIG. 16A, in accordance with example implementations, in general, the rod 1602 contains radially extending vanes 1608 for purposes of contacting inner surfaces of the ring assembly segments 410 and 420: vanes 1608-1 to contact the upper segments 410; and vanes 1608-2 to contact the lower segments 420. For the specific example implementation that is illustrated in FIGS. 16A and 16B, the setting tool 1600 includes six vanes 1608, i.e., three vanes 1608-1 contacting for the upper segments 410 and three vanes 1608-2 for contacting the lower segments 420. Moreover, as shown, the vanes 1608 may be equally distributed around the longitudinal axis 1601 of the setting tool 1600, in accordance with example implementations. Although the examples depicted herein show two layers of three segments, it is noted that an infinite possibility of combinations with additional layers or with a number of segments per layer may be used (combinations of anywhere from 2 to 20 for the layers and segments, as examples) and contemplated and are within the scope of the appended claims.

Figure 16C:
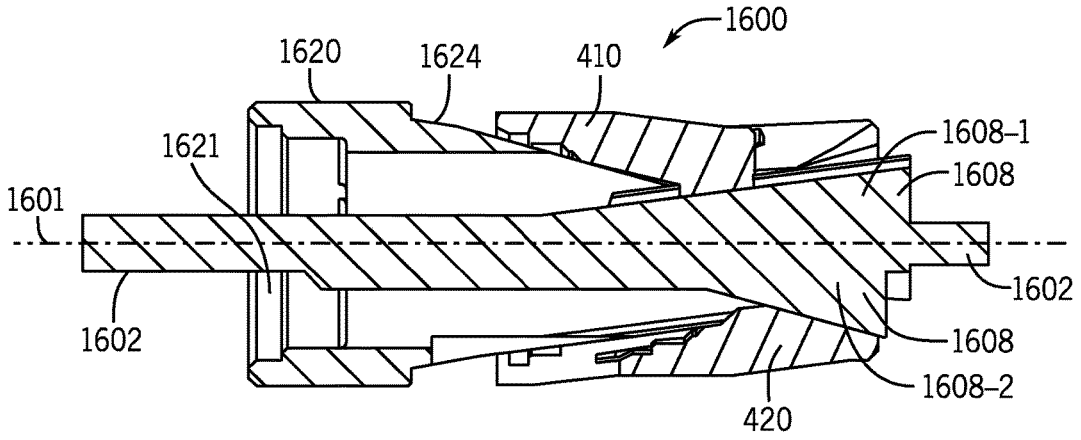
FIG. 16C is a cross-sectional view taken along line 16C-16C of FIG. 16A according to an example implementation.

Referring to FIG. 16C, relative motion of the rod 1602 relative to the mandrel 1620 longitudinally compresses the segments 410 and 420 along the longitudinal axis 1601, as well as radially expands the segments 410 and 420. This occurs due to the contact between the segments 410 and 420 with the inclined faces of the vanes 1608, such as the illustrated incline faces of the vanes 1608-1 and 1608-2 contacting inner surfaces of the segments 410 and 420, as depicted in FIG. 16C.

Figure 17:
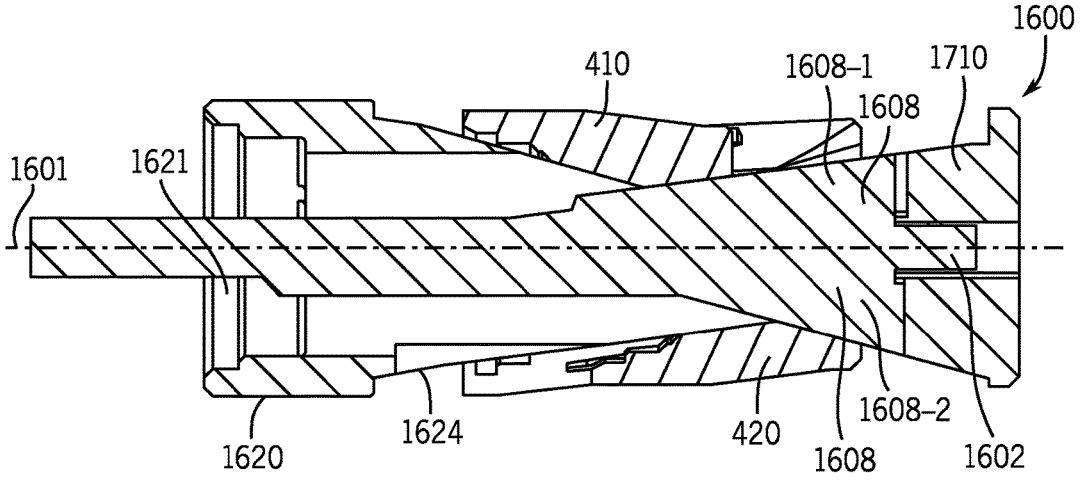
FIG. 17 is a cross-sectional view of a ring assembly setting tool and a segmented ring assembly according to a further example implementation.

FIG. 17 depicts a cross-sectional view for the ring assembly setting tool 1600 according to a further implementation. In general, for this implementation, the setting tool 1600 includes a bottom compression member 1710 that is disposed at the lower end of the rod 1602. As further disclosed below, the compression member 1710 aids in exerting a radial setting force on the segments 410 and 420 and may be released from the setting tool 1600 and left downhole with the expanded ring assembly (after the remainder of the setting tool 1600 is retrieved from the well) to form a retaining device for the ring assembly, as further discussed below.

Figure 18A:
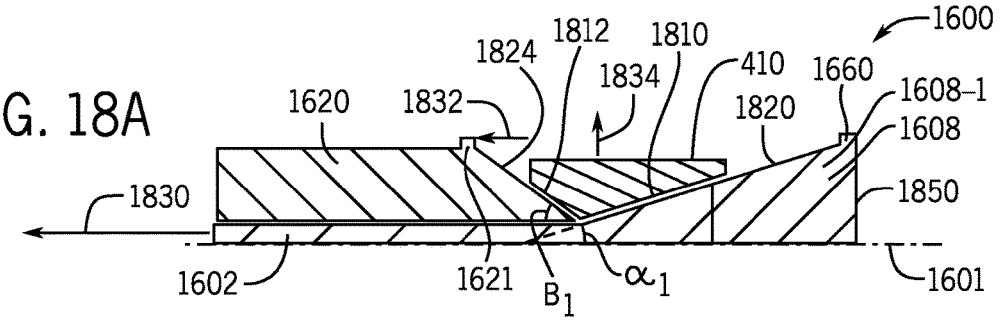
FIGS. 18A, 18B, 18C, 18D, 18E and 18F are cross-sectional views illustrating use of the setting tool to expand an upper segment of the ring assembly to transition the ring assembly to an expanded state according to an example implementation.

FIG. 18A depicts a partial cross-sectional view of the setting tool 1600, according to an example implementation, for purposes of illustrating forces that the tool 1600 exerts on the lower segment 410. It is noted that FIG. 18*a* depicts one half of the cross-section of the setting tool 1600 about the tool's longitudinal axis 1601, as can be appreciated by the skilled artisan.

Referring to FIG. 18A, an inclined, or sloped, surface 1820 of the vane 1608-1 and a sloped surface 1824 of the mandrel 1620 act on the upper segment 410 as illustrated in FIG. 18A. In particular, the sloped surface 1820 of the vane 1608-1 forms an angle $\alpha 1$ (with respect to the longitudinal axis 1601), which contacts an opposing sloped surface 1810 of the segment 410. Moreover, the sloped surface 1824 of the mandrel 1620 is inclined at an angle $\beta 1$ with respect to the longitudinal axis 1601. The sloped surface 1824 of the mandrel 1820, in turn, contacts an opposing sloped surface 1812 of the upper segment 410. The surfaces 1820 and 1824 have respective surface normals, which, in general, are pointed in opposite directions along the longitudinal axis 1601. Therefore, by relative movement of the rod 1602 in the illustrated uphole direction 1830, the surfaces 1820 and 1824 of the setting tool 1600 produce a net outward radial force 1834 on the segment 410, which tends to radially expand the upper segment 410. Moreover, the relative movement of the rod 1602 and mandrel 1620 produces a force 1832 that causes the segment 410 to longitudinally translate to a position to compress the segments 410 and 420 into a single layer.

Figure 19A:
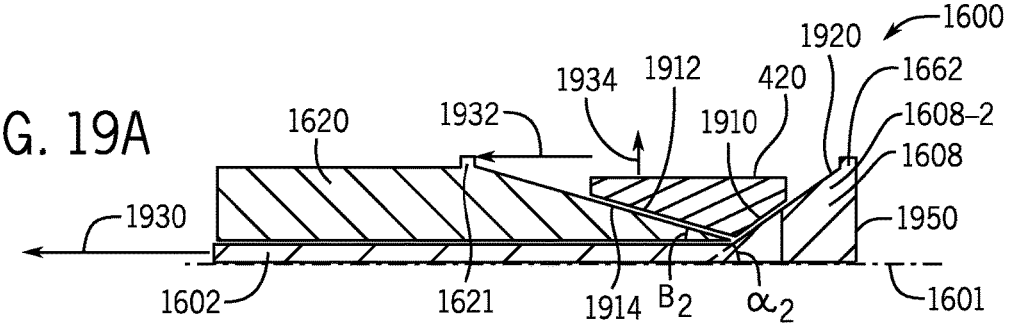
FIGS. 19A, 19B, 19C, 19D, 19E and 19F are cross-sectional views illustrating use of the setting tool to expand a lower segment of the ring assembly to transition the ring assembly to the expanded state according to an example implementation.

Referring to FIG. 19A, for the lower segment 420, the vane 1608-2 of the rod 1602 has a sloped surface 1920, which contacts a corresponding sloped surface 1910 of the lower segment 420; and the mandrel 1620 has a sloped surface 1914 that contacts a corresponding opposing sloped surface 1912 of the lower segment 420. As depicted in FIG. 19A, the slope surfaces 1914 and 1920 having opposing surface normals, which cause the relative movement between the rod 1602 and mandrel 1620 to produce a net radially outward force 1934 on the lower segment 410. Moreover, movement of the rod 1602 relative to the mandrel 1620 produces a longitudinal force 1932 to longitudinally translate the lower segment 420 into a position to compress the ring assembly 50 into a single layer. As shown in FIG. 19A, the sloped surfaces 1920 and 1914 have associated angles called "$\beta 2$" and "$\alpha 2$" with respect to the longitudinal axis 1601.

In accordance with example implementations, the $\alpha 1$ and $\alpha 2$ angles may be the same; and the $\beta 1$ and $\beta 2$ angles may be same. However, different angles may be chosen (i.e., the $\alpha 1$ and $\alpha 2$ angles may be different, as well as the $\beta 1$ and $\beta 2$ angles, for example), depending on the particular implementation. Having different slope angles involves adjusting the thicknesses and lengths of the segments of the ring assembly 50, depending on the purpose to be achieved. For example, by adjusting the different slope angles, the ring assembly 50 and corresponding setting tool may be designed so that all of the segments of the ring assembly are at the same height when the ring assembly 50 is fully expanded or a specific offset. Moreover, the choice of the angles may be used to select whether the segments of the ring assembly finish in an external circular shape or with specific radial offsets.

The relationship of the $\alpha$ angles (i.e., the $\alpha 1$ and $\alpha 2$ angles) relative to the $\beta$ angles (i.e., the $\beta 1$ and $\beta 2$ angles) may be varied, depending on the particular implementation. For example, in accordance with some implementations, the $\alpha$ angles may be less than the $\beta$ angles. As a more specific example, in accordance with some implementations, the $\beta$ angles may be in a range from one and one half times the $\alpha$ angle to ten times the $\alpha$ angle, but any ratio between the angles may be selected, depending on the particular implementation. In this regard, choices involving different angular relationships may depend on such factors as the axial displacement of the rod 1602, decisions regarding adapting the radial and/or axial displacement of the different layers of the elements of the ring assembly 50; adapting friction forces present in the setting tool and/or ring assembly 50; and so forth.

Figure 18B:
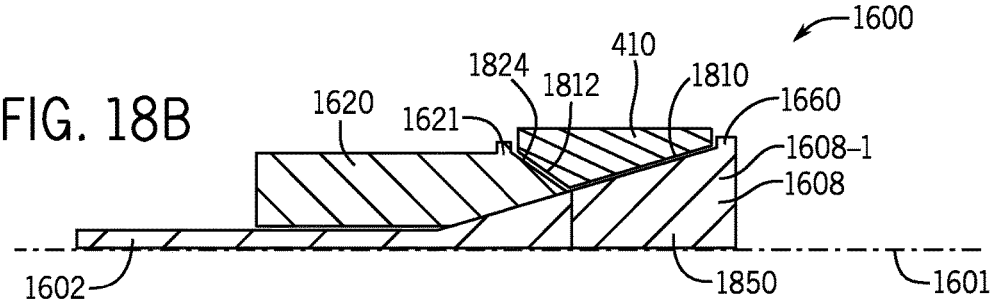

FIG. 18B depicts further movement (relative to FIG. 18A) of the rod 1602 with respect to the upper segment 410 mandrel 1620, resulting in full radial expansion of the upper seat segment 410; and FIG. 18B also depicts stop shoulders 1621 and 1660 that may be used on the mandrel 1620 and rod 1602, in accordance with some example implementations. In this manner, for the state of the setting that is depicted in FIG. 18A, relative travel between the rod 1602 and the mandrel 1620 is halted, or stopped, due to the upper end of the upper seat segment 410 contacting a stop shoulder 1621 of the mandrel 1620 and a lower stop shoulder 1660 of the vane 1608-2 contacting the lower end of segment 410. Likewise, FIG. 19B illustrates full radial expansion of the lower seat segment 420, which occurs when relative travel between the rod 1602 and the mandrel 1620 is halted due to the segment 420 resting between a stop shoulder 1625 of the mandrel 1620 and a stop shoulder 1662 of the vane 1608-2.

Figure 19B:
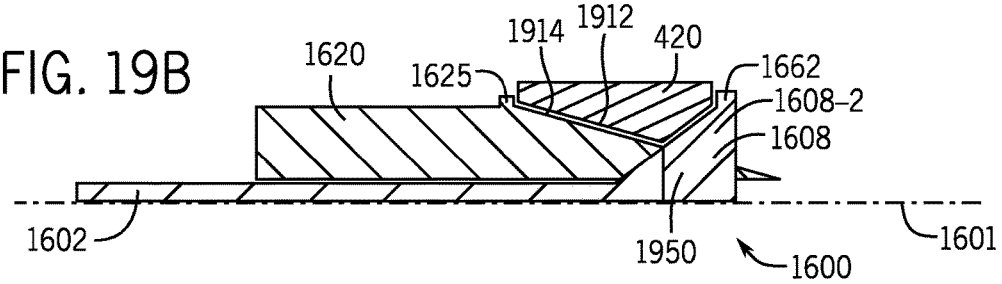

For the setting tool 1600 that is depicted in FIGS. 18A-19B, the tool 1600 includes a bottom compression member that is attached to the lower end of the mandrel 1620 and has corresponding member parts 1850 (contacting the segments 410) and 1950 (contacting the segments 420). In example with example implementations, compression members 1850 and 1950 may be the same part but are depicted in the figures at two different cross-sections for clarity. Thus, as shown in FIGS. 18A and 18B, the vane 1608-1 contains a compression member part 1850; and the vane 1608-2 depicted in FIGS. 19A and 19B depicts a compression member part 1950. In accordance with further implementations disclosed herein, the mandrel of a setting tool may not include such an extension. Moreover, although specific implementations are disclosed herein in which the rod of the setting tool moves with respect to the mandrel, in further implementations, the mandrel may move with respect to the rod. Thus, many variations are contemplated, which are within the scope of the appended claims.

Figure 18C:
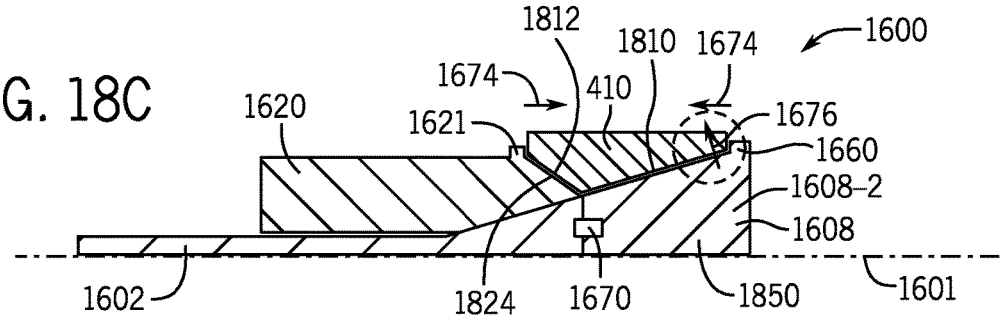
Figure 19C:
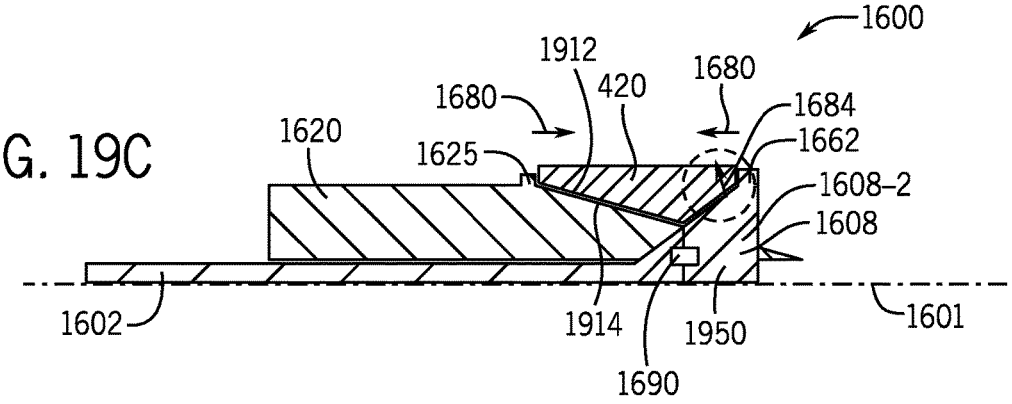

In accordance with further implementations, the bottom compression member of the rod 1602 may be attached to the remaining portion of the rod using one or more shear devices. In this manner, FIG. 18C depicts the compression member part 1850 being attached to the rest of the vane 1608-1 using a shear device 1670, such as a shear screw, for example. Likewise, FIG. 19C depicts the compression member part 1950 being attached to the remainder of the vane 1608-2 using a corresponding shear device 1690. The use of the compression member, along with the shear device(s) allows the setting tool to leave the compression member downhole to, in conjunction with the ring assembly 50, form a permanently-set seat in the well.

More specifically, the force that is available from the setting tool 1600 actuating the rod longitudinally and the force-dependent linkage that is provided by the shear device, provide a precise level of force transmitted to the compression member. This force, in turn, is transmitted to the segments of the ring assembly 50 before the compression member separates from the rod 1602. The compression member therefore becomes part of the ring assembly 50 and is released at the end of the setting process to expand the ring assembly 40. Depending on the particular implementation, the compression piece may be attached to the segments or may be a separate piece secured by one or more shear devices.

Thus, as illustrated in FIGS. 18C and 19B, through the use of the compression pieces, additional force, i.e., additional longitudinal forces 1674 (FIG. 18C) and 1680 (FIG. 19C); or additional radial forces 1676 (FIG. 18C) or 1684 (FIG. 19C); or a combination of both, may be applied to the ring assembly 50 to aid in expanding the ring assembly.

The above-described forces may be transmitted to a self locking feature and/or to an anti-return feature. These features may be located, for example, on the side faces of the ring assembly's segments and/or between a portion of all segments and the compression piece.

In accordance with some implementations, self locking features may be formed from tongue and groove connections, which use longitudinally shallow angles (angles between three and ten degrees, for example) to obtain a self-locking imbrication between the parts due to contact friction.

Anti-return features may be imparted, in accordance with example implementations, using, for example, a ratchet system, which may be added on the external faces of a tongue and groove configuration between the opposing pieces. The ratchet system may, in accordance with example implementations, contain spring blades in front of anchoring teeth. The anti-return features may also be incorporated between the segment (such as segment 410) and the compression member, such as compression member 1850. Thus, many variations are contemplated, which are within the scope of the appended claims.

FIGS. 18D, 19D, 18E, 19E, 18F and 19F depict using of the bottom compression member along with the shear devices, in accordance with an example implementation.

Figure 18D:
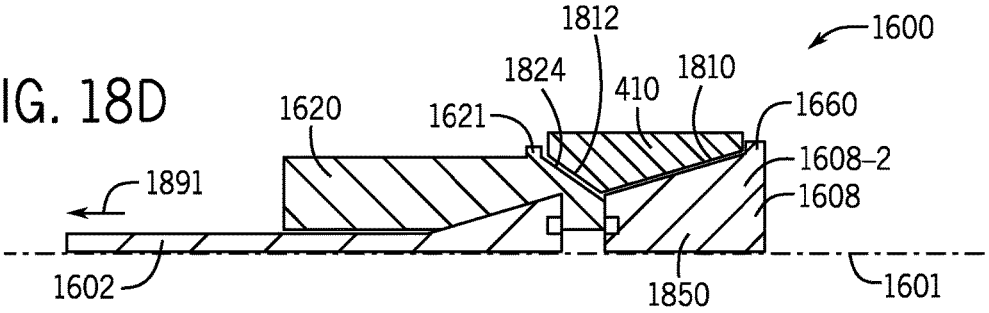
Figure 19D:
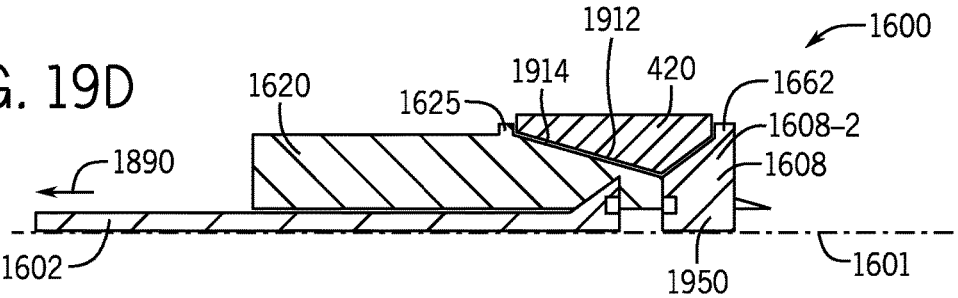
Figure 18E:
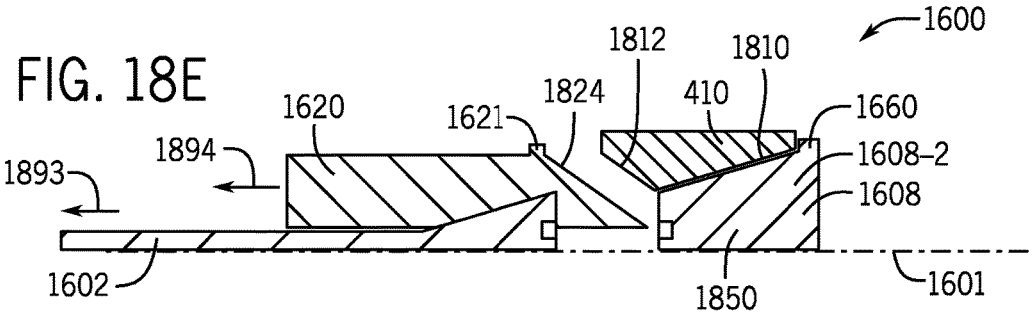
Figure 19E:
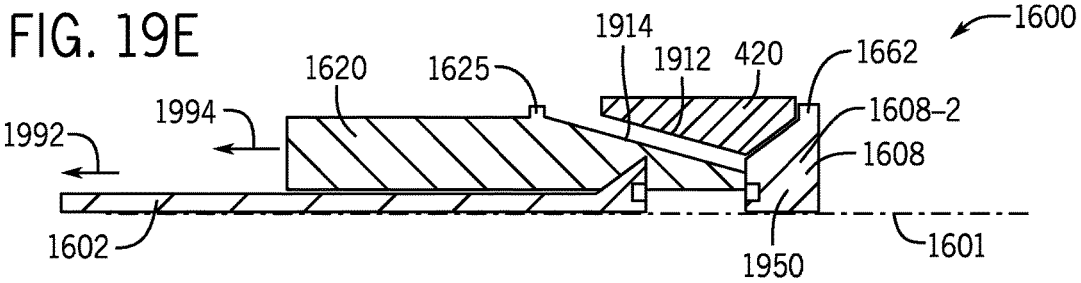
Figure 18F:
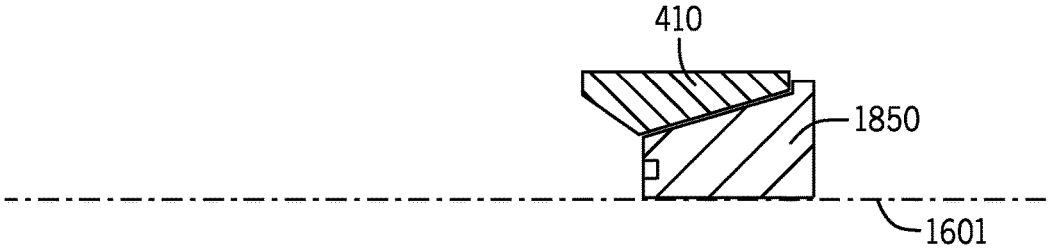
Figure 19F:
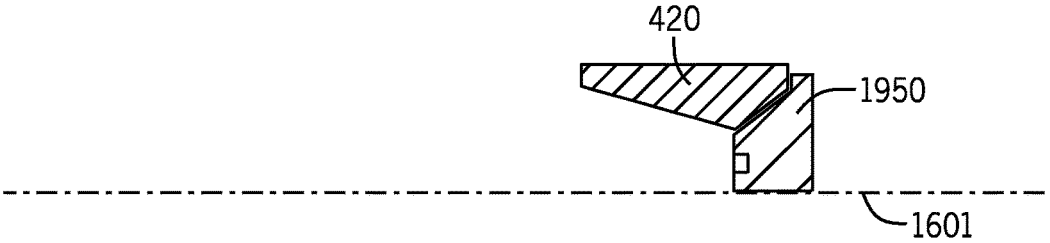
Figure 21A:
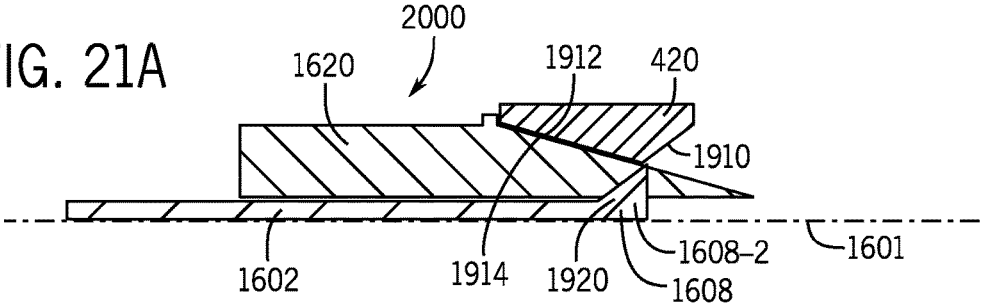
FIGS. 21A, 21B, 21C and 21D are cross-sectional views illustrating use of a setting tool to expand a lower segment of the ring assembly to transition the ring assembly to the expanded state according to a further example implementation.
Figure 21B:
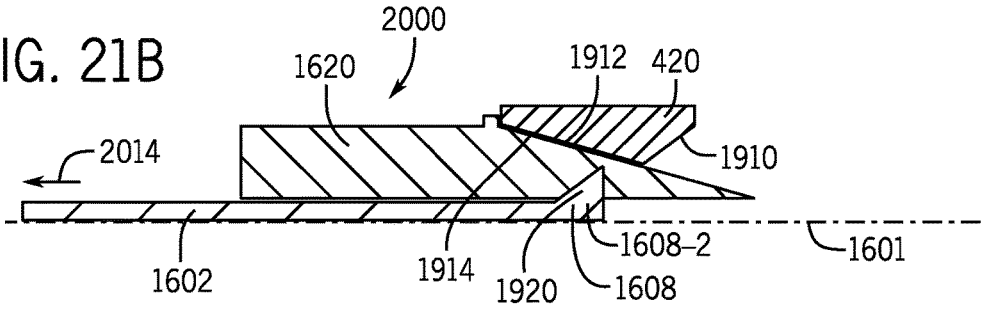
Figure 21C:
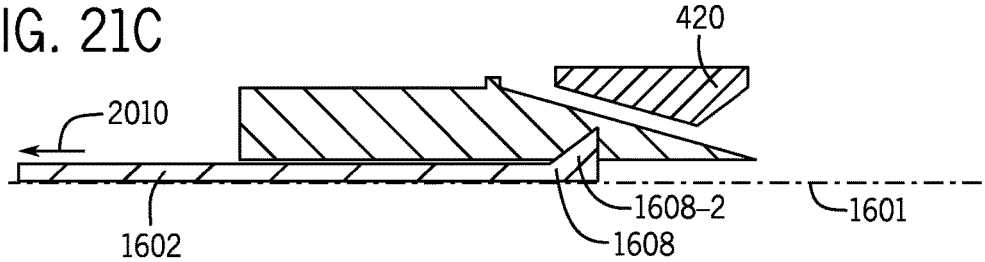

More specifically, FIGS. 18D and 19D depict separation of the compression member parts 1850 (FIG. 18D) and 1950 (FIG. 18E) from the rod 1602, thereby releasing the compression member from the rest of the setting tool, as illustrated in FIGS. 18E and 19E. As depicted in FIGS. 18F and 19F, after removal of the remainder of the setting tool 1600, the segments 410 (FIG. 18F) and 420 (FIG. 19F) and corresponding compression member parts 1850 and 1950 remain in the well. Thus, as illustrated in FIG. 18F, the compression piece 1850 stands alone with the upper segment 410; and the compression piece 1950 (see FIG. 19F) stands alone with the lower segment 420.

In accordance with some implementations, as discussed above, the segments 410 and/or 420 of the ring assembly may contain anchors, or slips, for purposes of engaging, for example, a tubing string wall to anchor, or secure, the ring assembly to the string.

In accordance with some implementations, the setting tool may contain a lower compression member on the rod, which serves to further expand radially the formed ring and further allow the ring to be transitioned from its expanded state back to its contracted state. Such an arrangement allows the ring assembly to be set at a particular location in the well, anchored to the location and expanded, a downhole operation to be performed at that location, and then permit the ring assembly to be retracted and moved to another location to repeat the process.

Figure 20A:
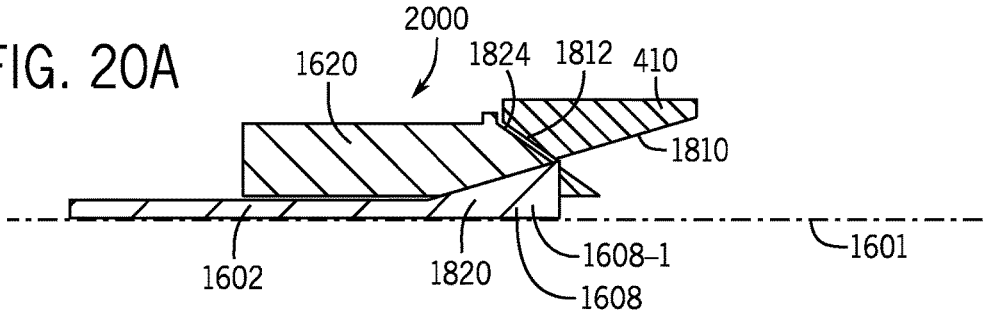
FIGS. 20A, 20B, 20C and 20D are cross-sectional views illustrating use of a setting tool to expand an upper segment of the ring assembly to transition the ring assembly to the expanded state according to a further example implementation.
Figure 20B:
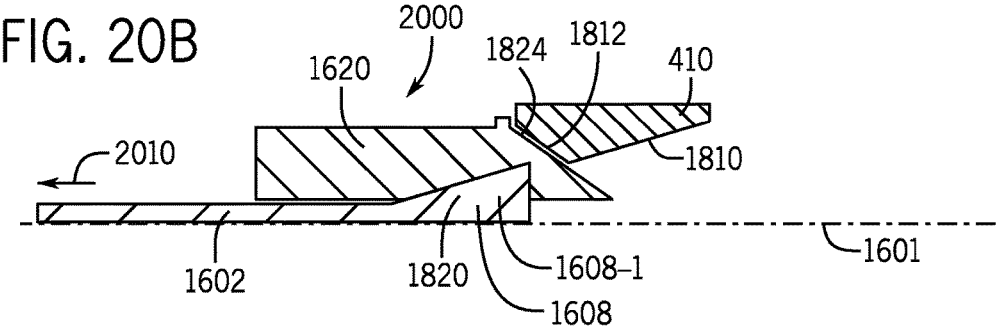
Figure 20C:
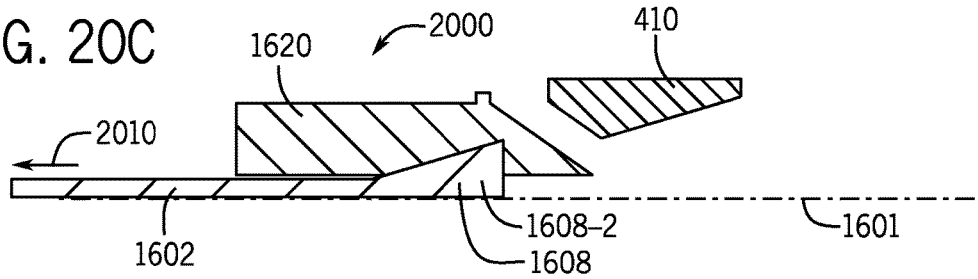
Figure 20D:
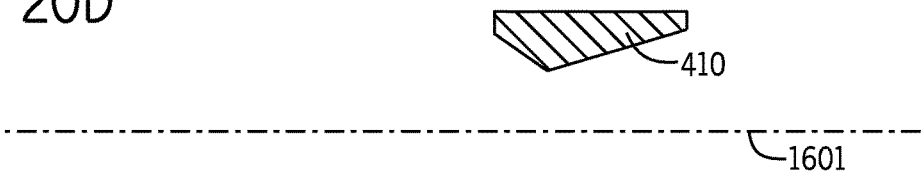
Figure 21D:
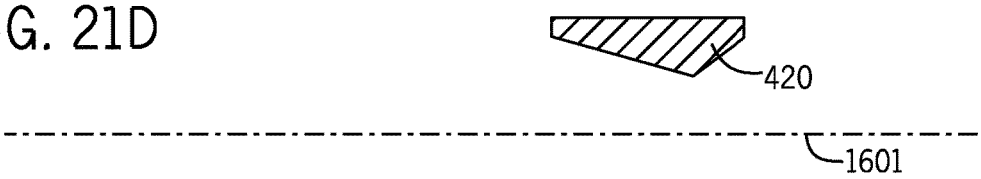

As a more specific example, FIGS. 20A, 20B, 20C and 20D depicts the actions of setting tool 2000 against the upper seat segment 410; and FIGS. 21A, 21B, 21C and 21D depict the actions of the setting tool 2000 against the lower seat segment 420. As shown, the setting tool 2000 does not have a lower compression member, thereby allowing the rod 1602 to be moved in a longitudinal direction (as illustrated by directions 210 of FIGS. 20B and 2014 of FIG. 21B) to radially expand the segments 410 and 420 and leave the segments 410 and 420 in the well, as illustrated in FIGS. 20D and 21D.

Figure 22A:
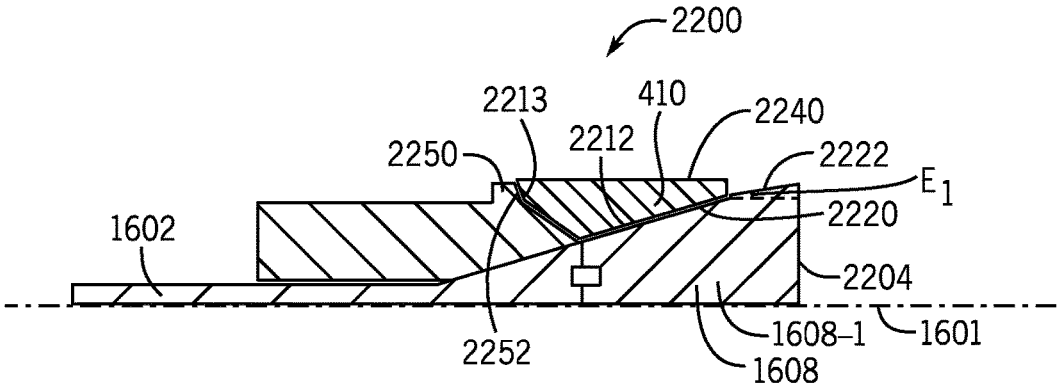
FIGS. 22A, 22B, 22C, 22D, 22E and 22F are cross-sectional views of a setting tool and a segmented ring assembly illustrating use of the setting tool to expand an upper segment of the ring assembly to transition the ring assembly to the expanded state according to an example implementation.

FIG. 22A depicts a ring assembly setting tool 2200 according to further implementations. For these implementations, a mandrel 2201 of the tool 2200 includes the above-described inclined faces to contact ring assembly segments. The mandrel 2201 also contains an end sloped segment on its outer diameter to ease the radial expansion of the segments while having a small axial movement for purposes of reducing friction and providing easier sliding movement. In this manner, as depicted in FIG. 22A, the mandrel 2201 contains a portion 2250 that has an associated sloped surface 2252 that engages a corresponding sloped surface 2213 of the upper seat segment 410. The sloped surface 2252 forms an associated angle called "$\zeta_1$" with respect to the radial direction from the longitudinal axis 1601. Likewise, the portion 2250 may have a sloped surface 2253 (see FIG. 22F) that engages a corresponding sloped surface 2215 of the lower seat segment 420 and forms an angle (called "$\zeta_2$") with respect to the radial direction. The angles $\zeta_1$ and $\zeta_2$ may be, equal to or steeper than the steepest of the $\alpha$ angles (the $\alpha 1$ and $\alpha 2$ angles) and the $\beta$ angles (the $\beta 1$ and $\beta 2$ angles), in accordance with some implementations.

Figure 22B:
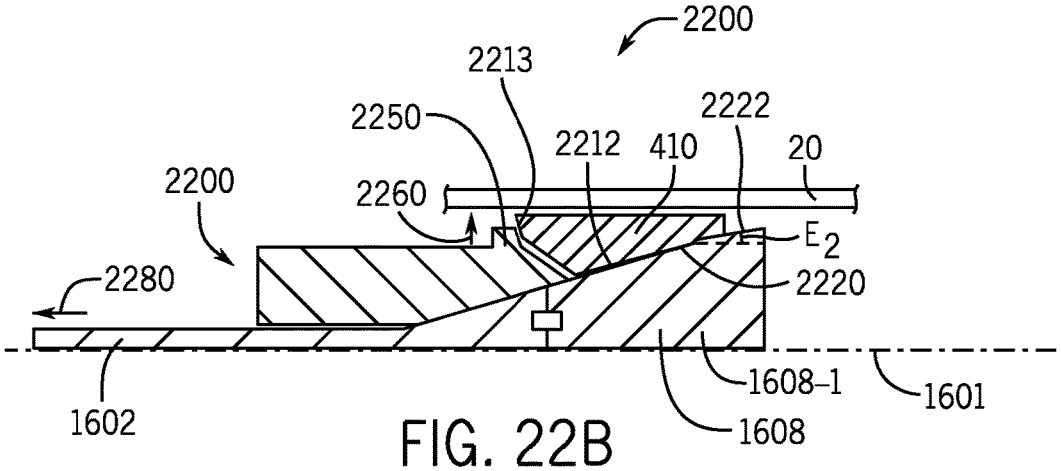
Figure 22C:
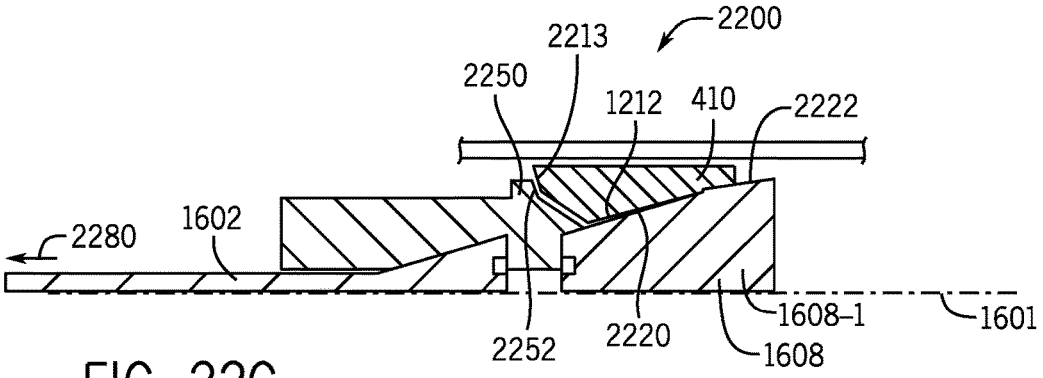

On the other side of the seat segments, an additional sloped surface may be added, in accordance with example implementations, in a different radial orientation than the existing sloped surface with the angle $\alpha 1$ for the upper segment 410 and $\beta 1$ for the lower segment 420. Referring to FIG. 22A, the tool 2200 includes a lower compression piece 2204 that includes a sloped surface 2220 having an angle $\varepsilon 1$ with respect to the longitudinal axis 1601. The angle $\varepsilon 1$ may be relatively shallow (a three to ten degree angle, for example, with respect to the longitudinal axis 1601) to obtain a self-locking contact between the upper seat segment 410 and the compression piece 2204. As depicted in the cross-section depicted in FIG. 22G, the upper seat segment 410 has sloped surfaces 2220 with the $\varepsilon_1$ angle and a sloped surface 2280 with the $\alpha 1$ angle. Referring to FIG. 22F, in a similar manner, the lower seat segment 420 may have surfaces that are inclined at angles $\alpha 2$ and $\varepsilon_2$. The $\varepsilon_2$ angle may be relatively shallow, similar to the $\varepsilon_1$ angle for purposes of obtaining a self-locking contact between the lower seat segment 420 and the compression piece.

Depending on the different slopes and angle configurations, some of the sloped surfaces may be combined into one surface. Thus, although the examples disclosed herein depict the surfaces as being separated, a combined surface due to an angular choice may be advantageous, in accordance with some implementations.

For the following example, the lower seat segment 420 is attached to, or integral with teeth, or slips 2292 (see FIG. 22H, for example), which engage the inner surface of the tubing string 20. The upper seat segment 410 may be attached to/integral with such slips, in accordance with further implementations and/or the seat segments 410 and 420 may be connected to slips; and so forth. Thus, many implementations are contemplated, which are with the scope of the appended claims.

Due to the features of the rod and mandrel, the setting tool 2200 may operate as follows. As shown in FIG. 22B, upon movement of the rod 1602 along a direction 2280, the upper seat segment 410 radially expands due to a resultant force along a radial direction 2260. At this point, the rod 1602 and compression piece 2204 remain attached. Referring to FIG. 22H, the lower seat segment 420 radially expands as well, which causes the slips 2292 to engage the tubing string wall. Upon further movement of the rod 1602 in the direction 2280, the compression piece 2204 separates from the remaining portion of the rod 1602, as illustrated in FIG. 22C. In a similar manner, referring to FIG. 22I, this separation also occurs in connection with the components engaging the lower seat segment 420.

Figure 22D:
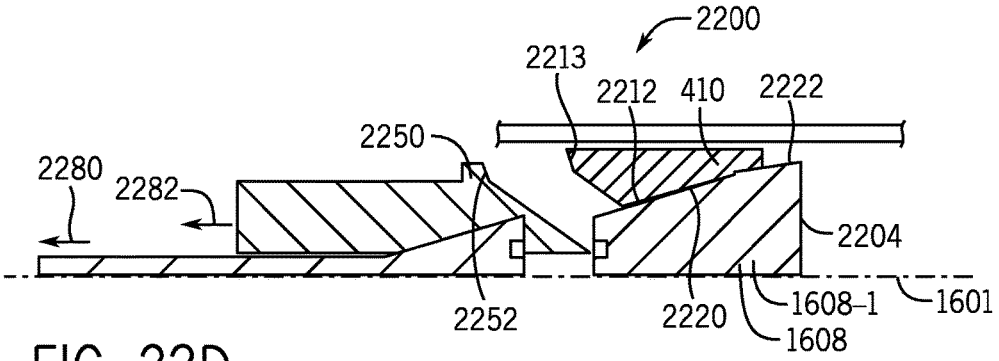
Figure 22E:
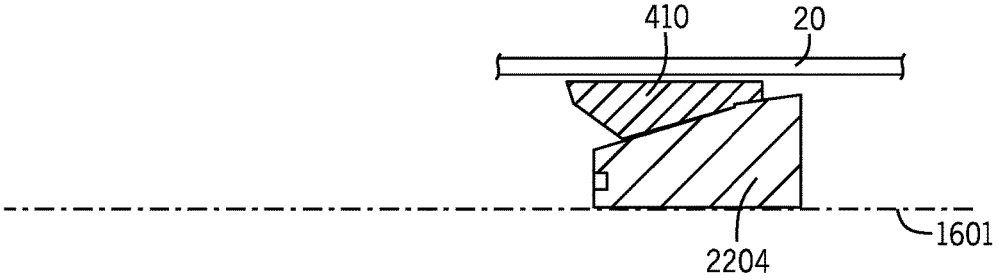
Figure 22F:
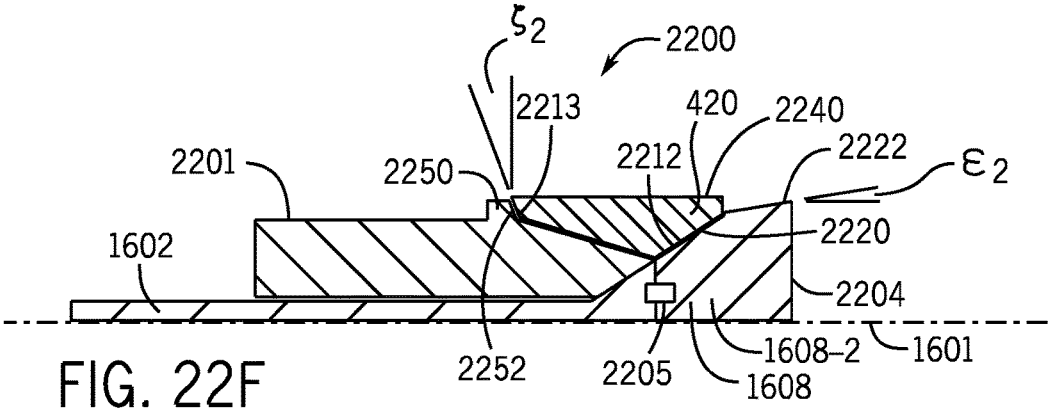
Figure 22G:
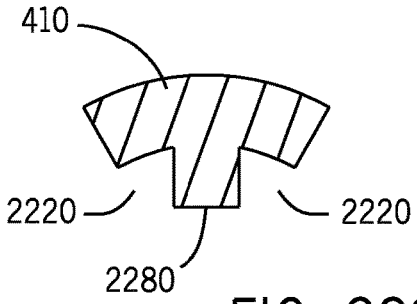
FIG. 22G is a cross-sectional view taken along line 22G-22G of FIG. 22A according to an example implementation.
Figure 22H:
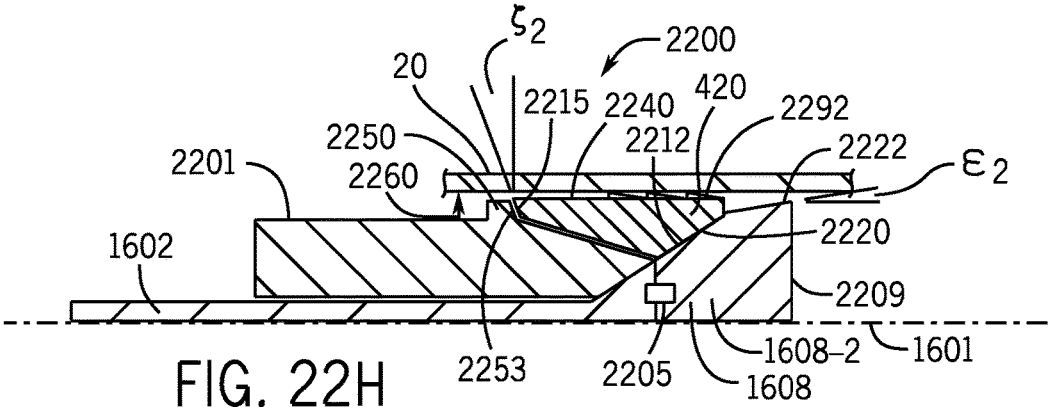
FIGS. 22H, 22I, 22J and 22K are cross-sectional views of the setting tool and the segmented ring assembly illustrating use of the setting tool to expand a lower segment of the ring assembly to transition the ring assembly to the expanded state according to an example implementation.
Figure 22I:
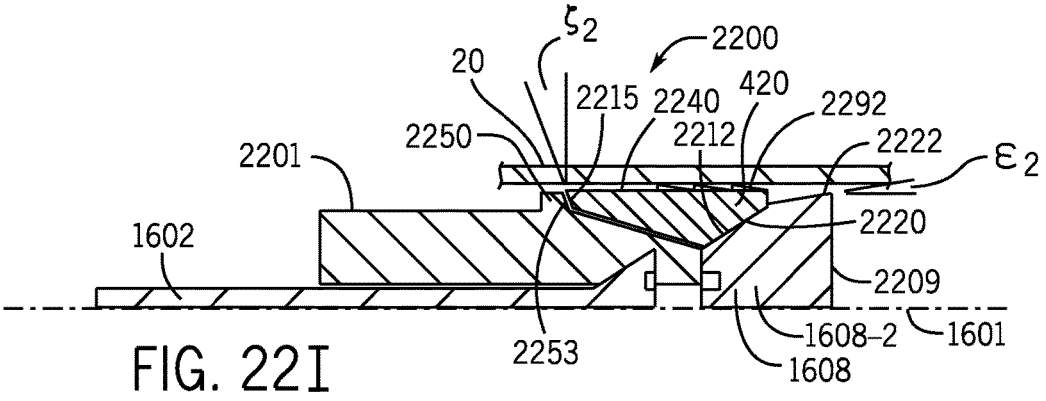
Figure 22J:
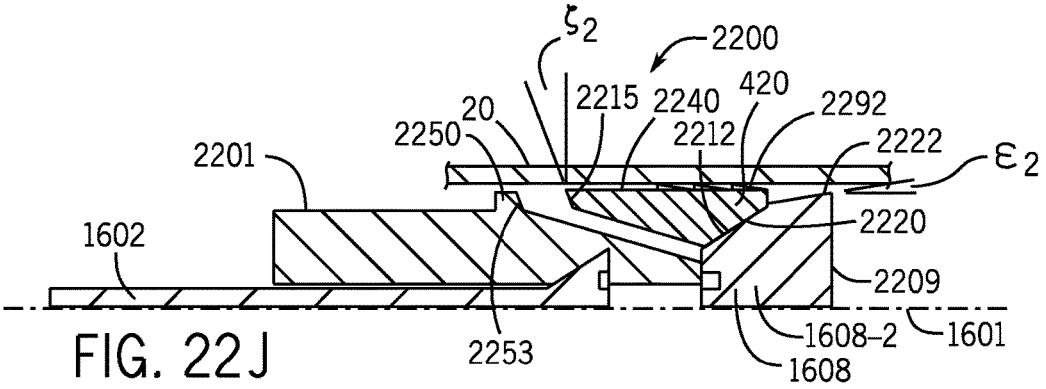
Figure 22K:
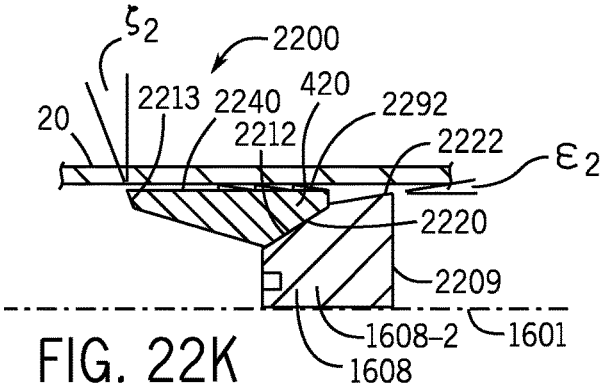

At this point, the segments are anchored, or otherwise attached, to the tubing string wall, so that, as depicted in FIGS. 22D and 22J, the remaining rod and mandrel may be further retracted uphole, thereby leaving the compression piece and segment down in the well, as further illustrated in FIGS. 22E and 22K.

Other implementations are contemplated, which are within the scope of the appended claims. For example, in accordance with some implementations, the segmented ring assembly may be deployed inside an expandable tube so that radial expansion of the segmented ring assembly deforms the tube to secure the ring assembly in place. In further implementations, the segmented ring assembly may be deployed in an open hole and thus, may form an anchored connection to an uncased wellbore wall. For implementations in which the segmented ring assembly has the slip elements, such as slip elements 2292 (see FIG. 22K, for example), the slip elements may be secured to the lower seat segments, such as lower seat segments 420, so that the upper seat segments 410 may rest on the lower seat segments 420 after the untethered object has landed in the seat of the ring assembly.

In example implementations in which the compression piece(s) are not separated from the rod to form a permanently-set ring assembly, the rod may be moved back downhole to exert radial retraction and longitudinal expansion forces to return the ring assembly back into its contracted state.

Figure 23:
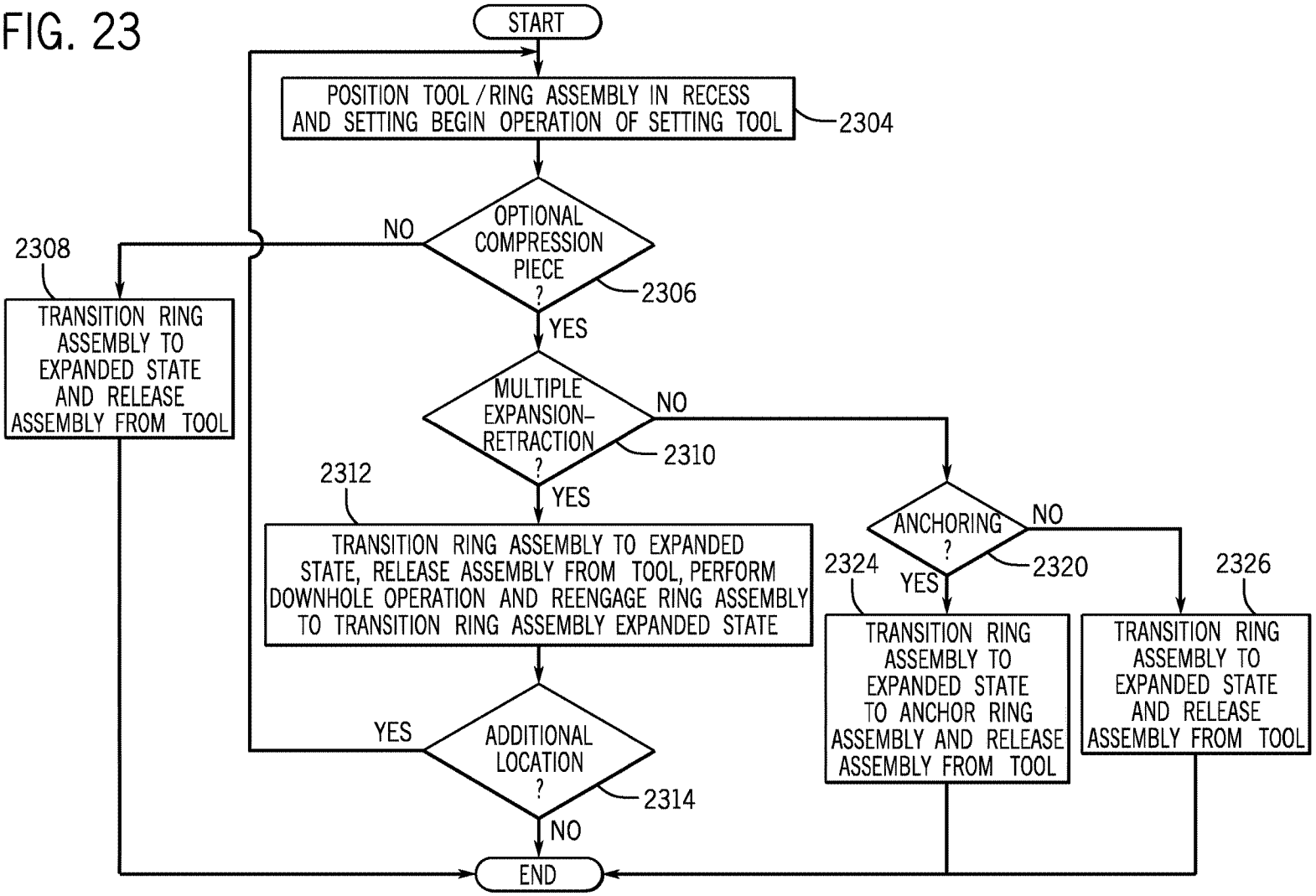
FIG. 23 is a flow diagram depicting a technique to use a setting tool to transition a segmented ring assembly between contracted and expanded states according to example implementations.

Thus, in general, a technique 2300 that is depicted in FIG. 23 may be performed in a well using a setting tool and a segmented ring assembly. Pursuant to the technique 2300, a tool and ring assembly is positioned in a recess of a tubing string (as an example) and movement of the tool is initiated, pursuant to block 2304. If the setting tool contains an optional compression piece (decision block 2306) and if multiple expansion and retraction is to be performed for purposes of performing multiple downhole operations (decision block 2310), then the technique 2300 includes transitioning the ring assembly to an expanded state, releasing the assembly from the tool, performing a downhole operation and then reengaging the ring assembly with the setting tool to transition the ring assembly back to the contracted state. If more downhole locations are to be performed (decision block 2314), then control transitions back to box 2304.

Otherwise, pursuant to the technique 2300, if the setting tool does not contain the compression piece (decision block 2306), then the technique 2300 includes transitioning the ring assembly to the expanded state and releasing the assembly from the tool, pursuant to block 2308. If the setting tool contains the compression piece but multiple expansions and retractions of the ring assembly is not to be used (decision block 2310), then use of the tool depends on whether anchoring (decision block 2320) is to be employed. In other words, if the ring assembly is to be permanently anchored, then the flow diagram 2300 includes transitioning the ring assembly to the expanded state to anchor the setting tool to the tubing string wall and releasing the assembly from the tool, thereby leaving the compression piece downhole with the ring assembly to form a permanent seat in the well. Otherwise, if anchoring is not to be employed, the technique 2300 includes transitioning the ring assembly to the expanded state and releasing the ring assembly from the tool, pursuant to block 2326, without separating the compression piece from the rod of the setting tool, pursuant to block 2326.

Figure 24A:
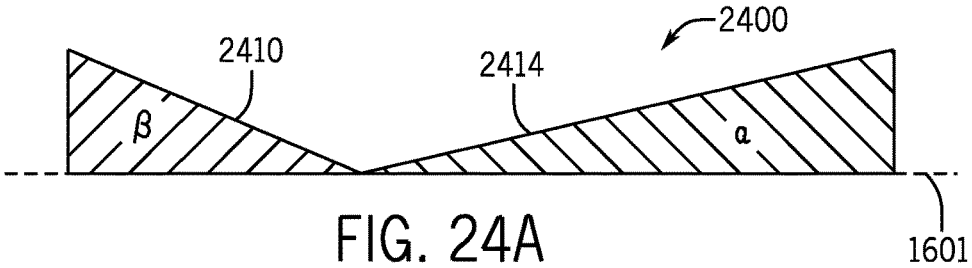
FIGS. 24A and 24B illustrate surfaces of the rod and mandrel of a ring assembly setting tool for a two layer ring assembly according to an example implementation.
Figure 24B:
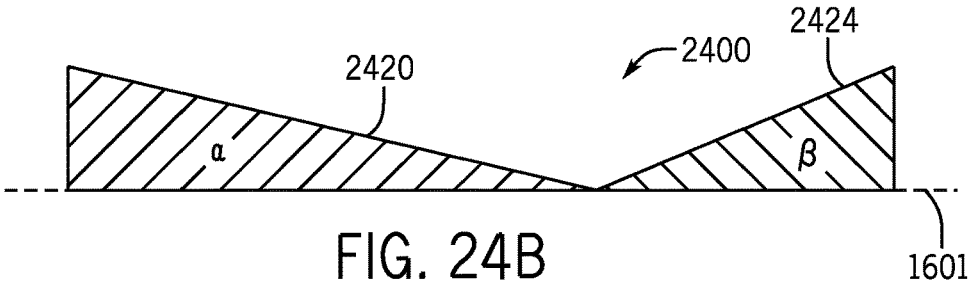
Figure 25A:
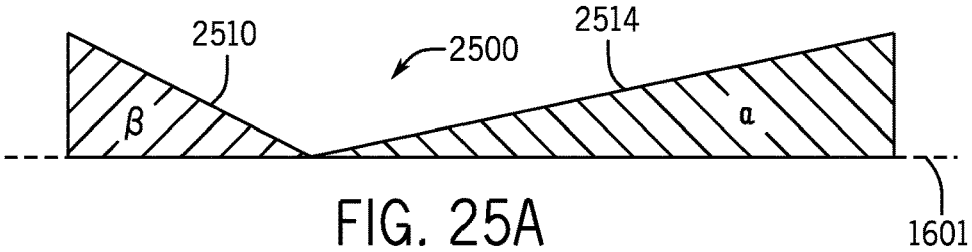
FIGS. 25A, 25B and 25C illustrate surfaces of the rod and mandrel of a ring assembly setting tool for a three layer ring assembly according to an example implementation.
Figure 25B:
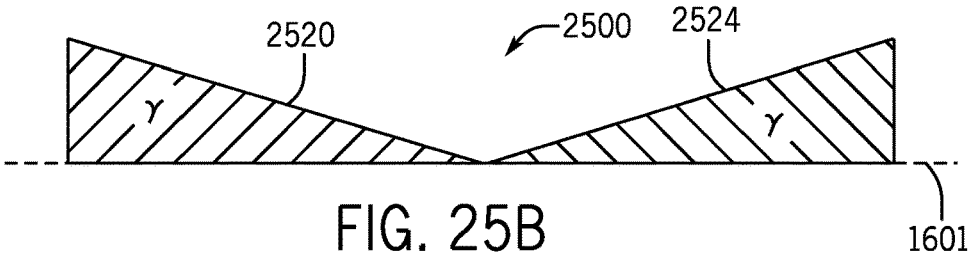
Figure 25C:
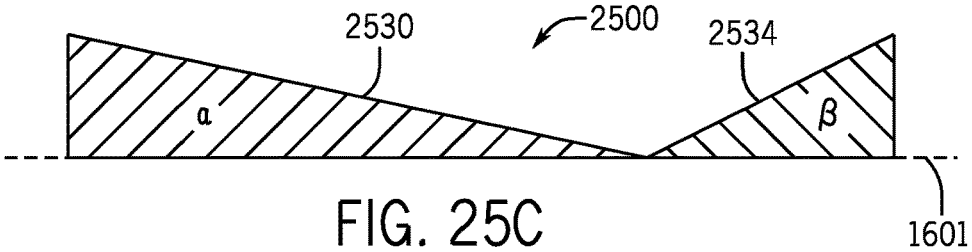
Figure 26A:
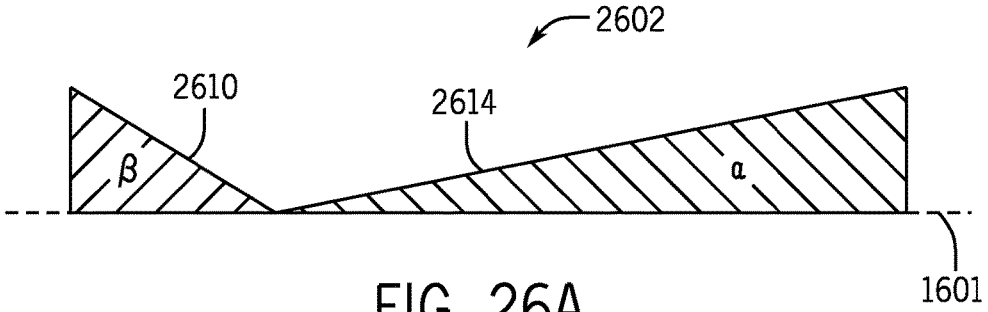
FIGS. 26A, 26B, 26C and 26D illustrate surfaces of the rod and mandrel of a ring assembly setting tool for a four layer ring assembly according to an example implementation.
Figure 26B:
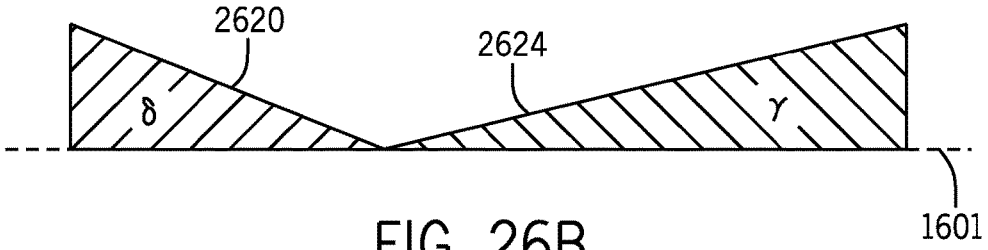
Figure 26C:
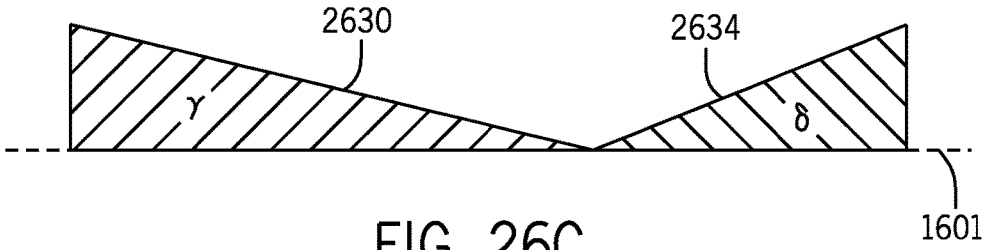
Figure 26D:
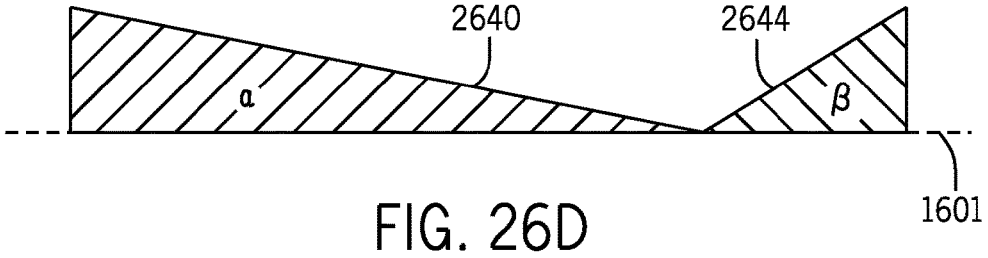

Many variations are contemplated, which are within the scope of the appended claims. For example, to generalize, implementations have been disclosed herein in which the segmented ring assembly has segments that are arranged in two axial layers in the contracted state of the assembly. The ring assembly may, however, have more than two layers for its segments in its contracted, in accordance with further implementations. Thus, in general, FIGS. 24A and 24B depict surfaces 2410 and 2414 (FIG. 24A) for an upper segment of a two layer ring assembly and corresponding surfaces 2420 and 2424 (FIG. 24B) for the lower segment of the two layer assembly. FIGS. 25A, 25B and 25C depict surfaces 2510 and 2514 (FIG. 25A), 2520 and 2524 (FIG. 25B), and 2530 and 2534 (FIG. 25C) for upper, intermediate and lower segments of a three layer ring assembly. FIG. 26A (showing layers 2610 and 2614), 26B (showing layers 2620 and 2624), 26C (showing layers 2630 and 2634) and 26D (showing layers 2640 and 2644) depict surfaces of the rod and mandrel for upper-to-lower segments of a four layer segmented ring assembly. Thus, many variations are contemplated, which are within the scope of the appended claims.

In accordance with example implementations, two elements are used to axially squeeze, or compress, a segmented ring assembly for purposes of producing radially and tangentially acting forces to radially expand the assembly, form metal-to-metal seals between the assembly and each element; and form metal-to-metal fluid seals between the segments of the assembly. In this manner, in accordance with example implementations, these two elements include one fixed element, which is secured to the well (secured to the downhole completion, for example) and an unfixed element, which is deployed in the well to engage the ring assembly and in conjunction with the fixed element, compress the ring assembly.

Figure 27A:
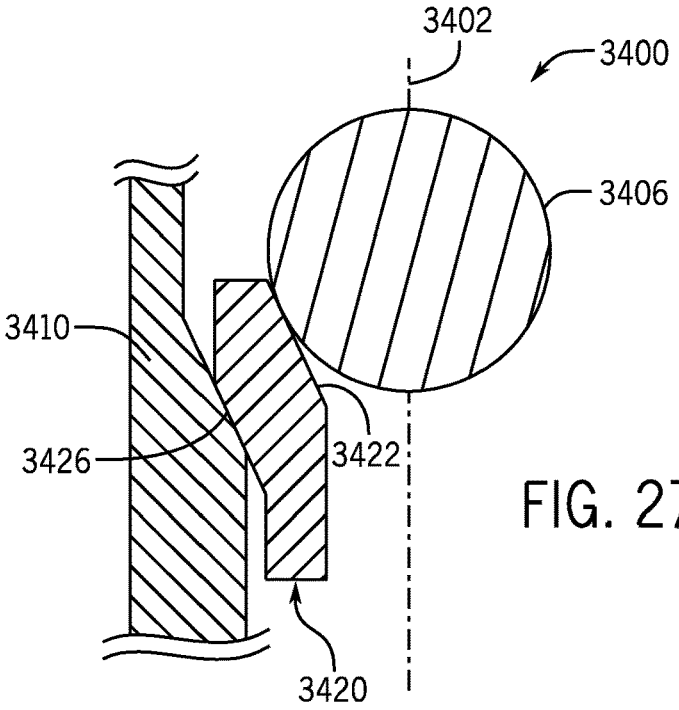
FIG. 27A is a perspective cross-sectional view of a segmented ring assembly in a well after an activation ball has been landed in the assembly according to a further example implementation.

Referring to FIG. 27A, as a more specific example, a segmented ring assembly 3420 may be part of an assembly 3400 to form a fluid obstruction, or barrier, downhole in the well. For this example, the segmented ring assembly 3420 is disposed between an untethered object, which in this example is a solid activation ball 3406, and a fixed element, which in this example is a tubular element 3410. The activation ball 3406 may be replaced by another untethered object, in further example implementations, such as a hollow activation ball, a dart, a bar, an object having a conical shape, and so forth, depending on the particular implementation. The tubular element 3410, may be, as examples, a casing string; a tubing string; or a fixed or sliding portion of a sleeve valve, such as a fracturing sleeve valve or flow valve. Moreover, in accordance with further example implementations, the tubular member 3410 may be deformable tubing. Therefore, depending on the particular implementation, the assembly 3400 may be used in a cased well in which the tubular member 3410 is cemented into place (as an example) in the well or in an open hole completion in which the tubular member 3410 may be held in place via one or more packers. Thus, many implementations are contemplated, which are within the scope of the appended claims.

For the example implementation depicted in FIG. 27A, the activation ball 3406 is deployed in the well (from the Earth surface of the well, for example) to land in a seat of the ring assembly 3420. In particular, for the example shown in FIG. 27A, the activation ball 3406 has landed in and contacts a receiving surface 3422 of the ring assembly 3420. The receiving surface 3422 may form a relatively thin, continuous annular surface, or ring, which circumscribes a longitudinal axis 3402 of the tubular member 3410 to form a metal-to-metal seal with the activation ball 3406, as described herein.

Figure 27B:
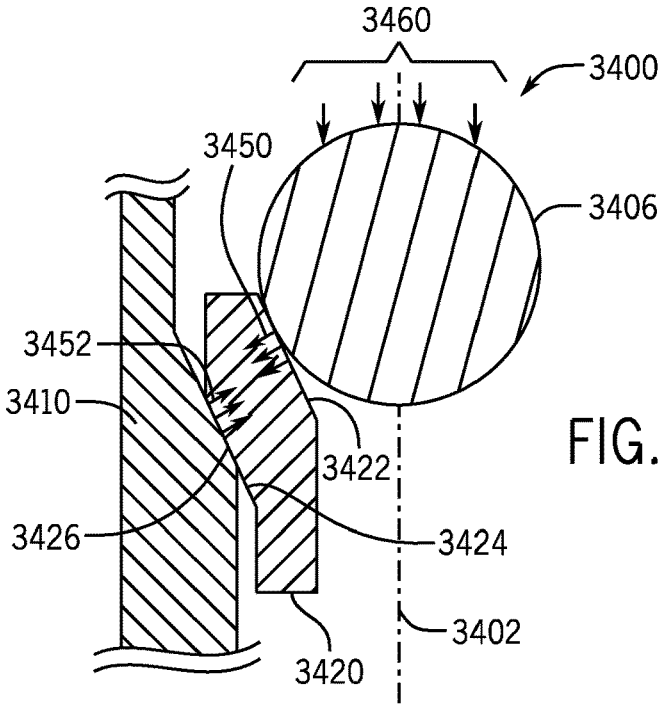
FIG. 27B is the perspective cross-sectional view of FIG. 27A further illustrating forces exerted on the ring assembly due to fluid pressure being applied to the activation ball according to an example implementation.

Referring to FIG. 27B, fluid may be pumped downhole in the well to create a fluid column above the activation ball 3406 to exert pushing forces 3460 against the activation ball 3406. The forces 3460 act along the longitudinal axis 3402 to push the activation ball 3406 against the ring assembly 3420.

Figure 29:
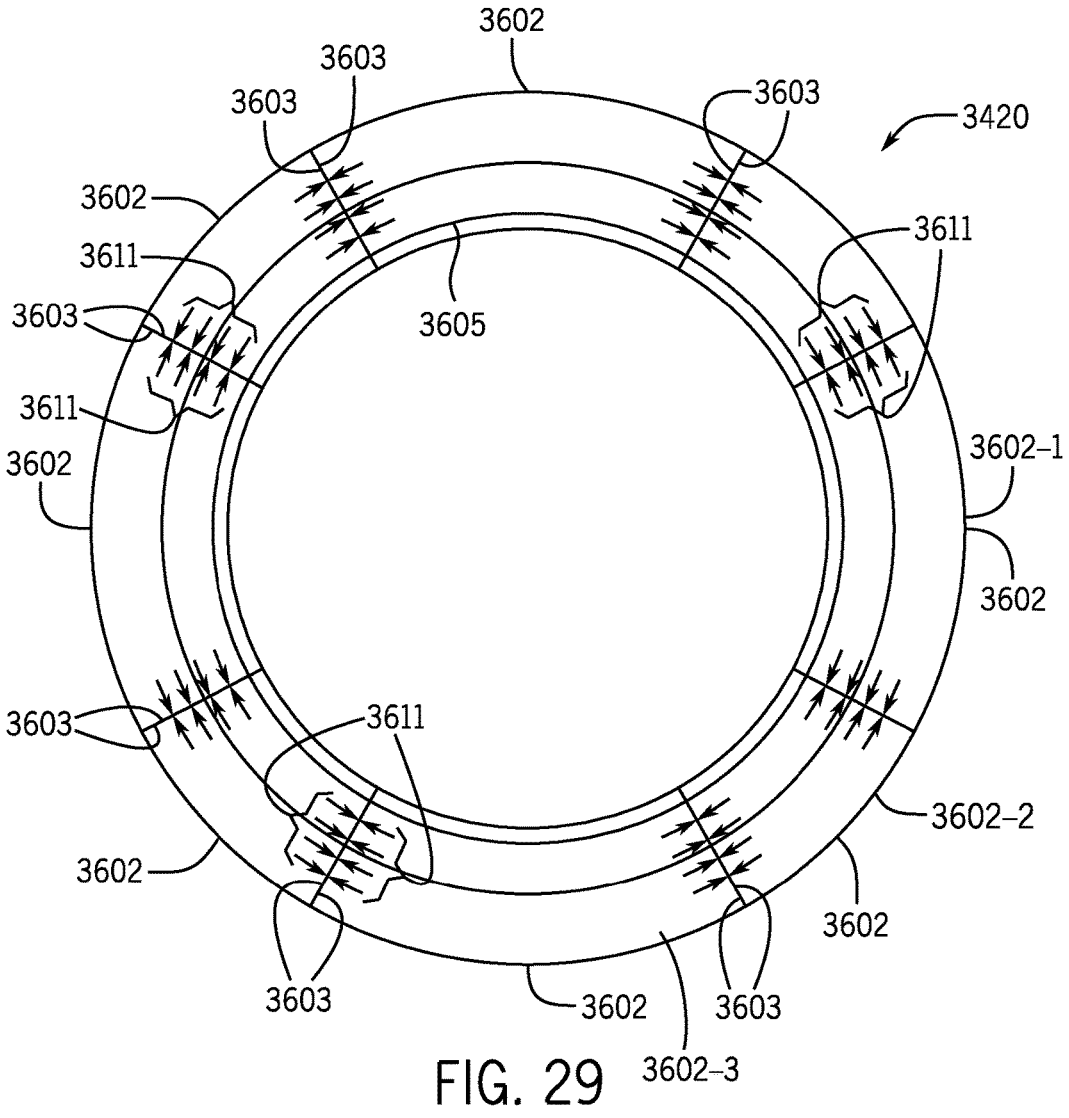
FIG. 29 is a top view of the segmented ring assembly according to an example implementation.

The forces 3460 that are exerted against the activation ball 3406 produce corresponding forces 3450, which act against the surface 3422 of the ring assembly 3420. Moreover, the forces 3450 produce corresponding reaction forces 3426 that act against the ring assembly 3420, where a frustoconical outer surface 3424 of the ring assembly 3420 contacts a corresponding mating profiled surface 3426 of the tubular member 3410. Thus, via the applied fluid pressure, the ring assembly 3420 is compressed between the activation ball 3406 and the tubular member 3410. This compression produces radially acting forces that expand the seat assembly 3420 and press the assembly 3420 against the tubular member 3410 to form a metal-to-metal seal with the member 3410. Referring to FIG. 29 in conjunction with FIG. 27B, the compression also produces tangentially acting forces 3611 against the ends of adjacent segments 3602 of the segmented ring assembly 3420 to form corresponding metal-to-metal fluid seals between adjacent segments 3602 of the ring assembly 3420. Due to the above-described metal-to-metal fluid seals, a fluid obstruction, or barrier, is created in the well.

In accordance with further, example implementations, one or more materials made be deposited on, attached to, bonded to or otherwise affixed to the surface 3422 to enhance the sealing of the fluid obstruction. For example, in accordance with example implementations, a sealant element, such as an overmolding (an elastomer material, a Teflon®-based material, and so forth) may be added or deposited on the surface 3422. The material(s) may be bonded between the adjacent end faces of the segments 3602 to enhance the fluid seals between the segments 3602 in accordance with further example implementations.

In accordance with further example implementations, elements may be added to the fluid (such as fibers, for example) that is pumped to reach the sealing surface 3422 for purposes of enhancing the sealing of the fluid obstruction. As another example, the sealing of the fluid obstruction may be enhanced through the use of a high viscosity fluid that is pumped to reach the sealing surface 3422.

Figure 30:
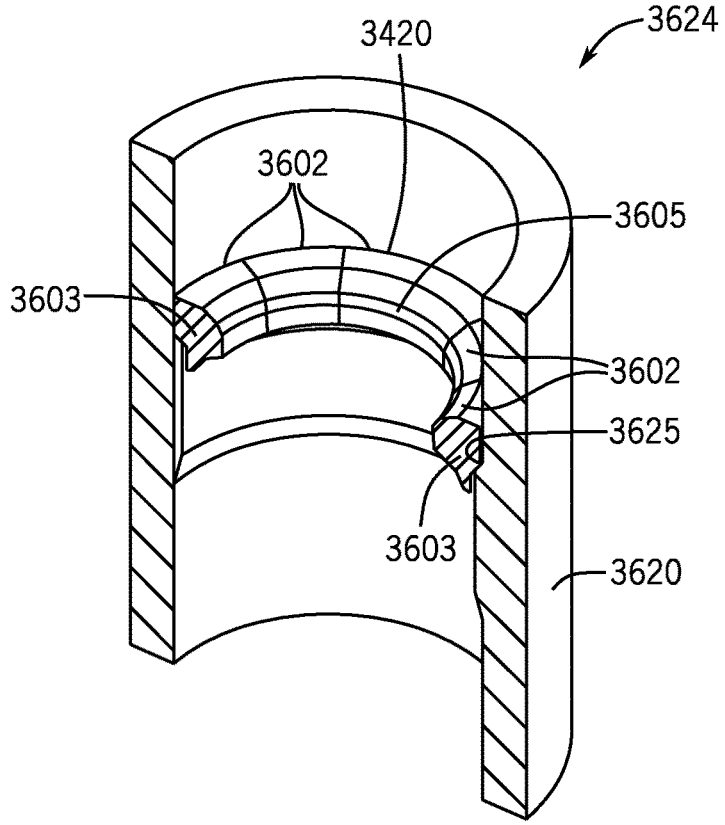
FIG. 30 is a schematic cross-sectional view of the segmented ring assembly and a tubular member in which the ring assembly is seated according to an example implementation.
Figure 31:
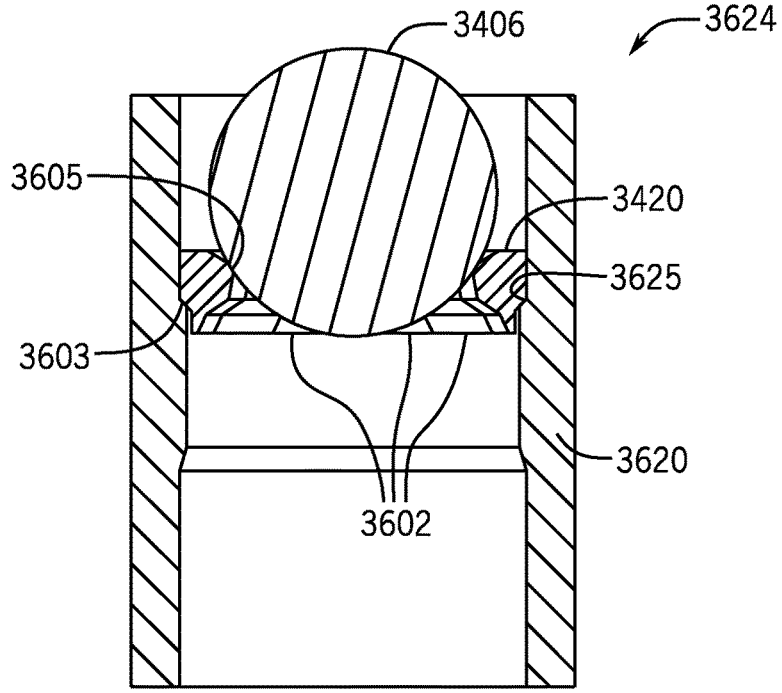
FIG. 31 is a cross-sectional view of an activation ball, segmented ring assembly and tubular member according to an example implementation.

FIG. 30 depicts a more specific example implementation, in which the segmented ring assembly 3420 is seated in the tubular member 3620. For this example implementation, the tubular member 3620 contains a profiled inner surface 3625 to receive the ring assembly 3420. Moreover, as depicted in FIG. 30, the segmented ring assembly 3420 also contains a profiled surface to receive the activation ball 3406, as depicted in the cross-sectional view of FIG. 31. This profiled surface of the ring assembly 3420 has a corresponding relatively thin annular surface 3605 that forms a continuous seat, or ring, when the ring assembly 3420 is fully radially expanded (as depicted in FIG. 30) for purposes of forming a fluid seal between the outer surface of the activation ball 3406 and the ring assembly 3420.

In accordance with further example implementations, the segmented ring assembly 3420 may be axially squeezed, or compressed, using an element other than an untethered object. For example, referring to FIG. 28A, in accordance with further example implementations, a tool 3504 may be run downhole (on a conveyance line or by pumping the tool 3504 downhole, as examples) to engage the assembly 3420. It is noted that the tool 3504 may be tethered to a conveyance line or may be an untethered object. Moreover, the tool may be used in the well for purposes of performing a downhole function in addition to the function of forming a fluid barrier with the ring assembly. In this manner, the tool 3504 may be a valve (, a sleeve valve or a ball valve, as examples), a perforating gun, packer, an instrumented testing tool, and so forth. The tool 3504 may also be part of a coiled tubing string, a slick line string, a drill-pipe or tubing conveyed tool. In accordance with further example implementations, the tool 3504 may be used to deploy the segmented ring 3420, in a similar manner to how the setting tool itself 1600 (see FIG. 16A) deploys a segmented ring assembly, as described herein.

Figure 28A:
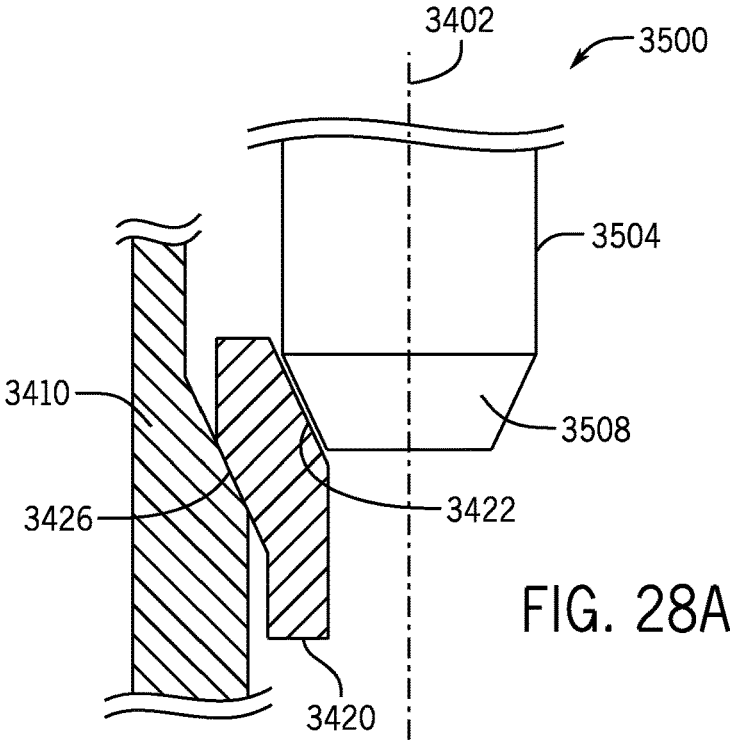
FIG. 28A is a perspective cross-sectional view of a segmented ring assembly when in contact with a tool according to a further example implementation.
Figure 28B:
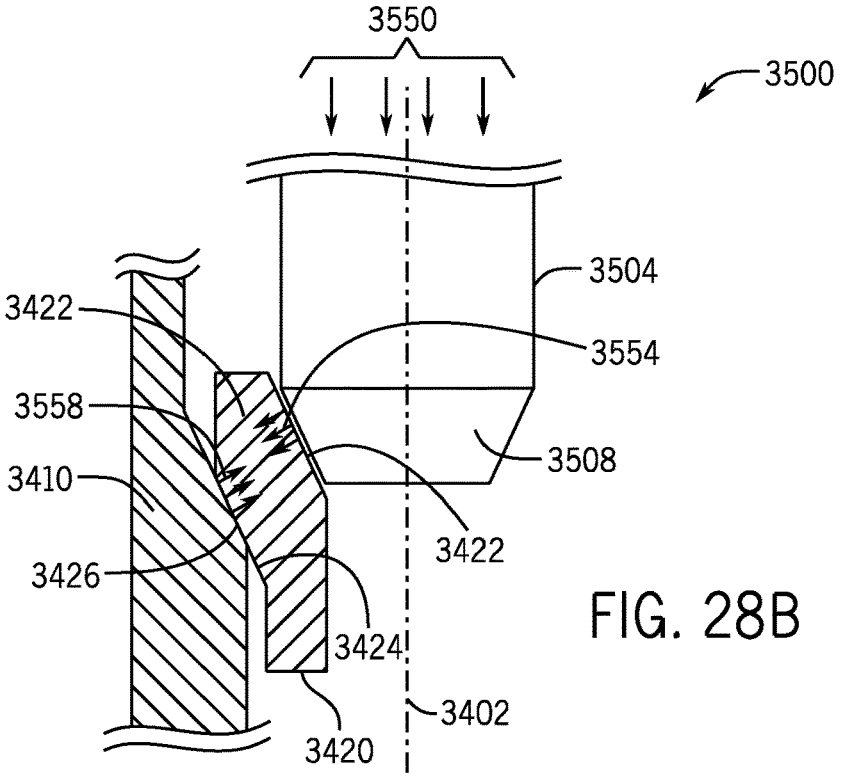
FIG. 28B is the perspective cross-sectional view of FIG. 28A illustrating forces exerted on the ring assembly due to contact of the tool with the ring assembly according to an example implementation.

The tool 3504 contains a profiled surface 3508, which is constructed to engage the receiving surface 3422 of the ring assembly 3420, as illustrated in FIG. 28B. By moving the tool 3504 along the longitudinal axis 3402 into contact with the ring assembly 3420 to press against the assembly 3420 (via movement of a conveyance line or the pumping of fluid into the well, as examples), radially and tangentially acting forces are produced to cause the segmented ring assembly 3420 to form corresponding metal-to-metal seals between the assembly 3420 and the tubular member 3410, between the assembly 3420 and the profiled surface 3508 of the tool 3504, and between the segments of the assembly 3420. This is illustrated in FIG. 28B, in which downhole forces 3550 are applied to the tool 3504 for purposes of producing corresponding forces 3554 and 3558, which, in turn, produce the corresponding tangential forces 3611 that are depicted in FIG. 29. Downhole forces 3550 can be applied by pumping fluid from Earth surface or from a downhole tool, and creating a pressure differential. Downhole forces 3550 can be applied by the tool 3504 itself. As examples, this force 3550 can be generated from surface by direct pull/push contact as for coiled Tubing, slickLine, drill Pipe or Tubing, depending on mechanism of conveyance. This force 3504 could also be generated from the tool 3504 itself through internal shifting movement (such as hydraulic, electrical, pyrotechnic actuation) or through a conveyance assistance mechanism, such a tractor, for example.

Figure 32A:
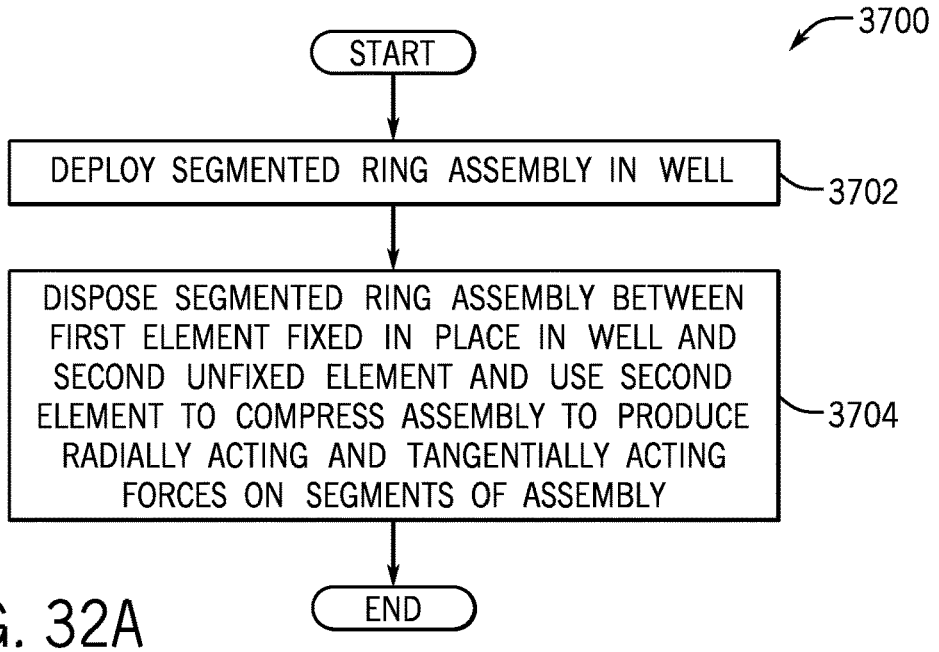
FIGS. 32A, 32B and 32C are flow diagrams illustrating techniques to deploy and use a segmented ring assembly in a well according to example implementations.

Referring to FIG. 32A, in summary, a technique 3700 in accordance with example implementations includes deploying (block 3702) a segmented ring assembly into a well and disposing (block 3704) the segmented ring assembly between a first element that is fixed in place in the well and a second unfixed element. The technique 3700 further includes using (block 3706) the second element to compress the assembly to produce radial and tangentially acting forces on segments of the assembly.

Figure 32B:
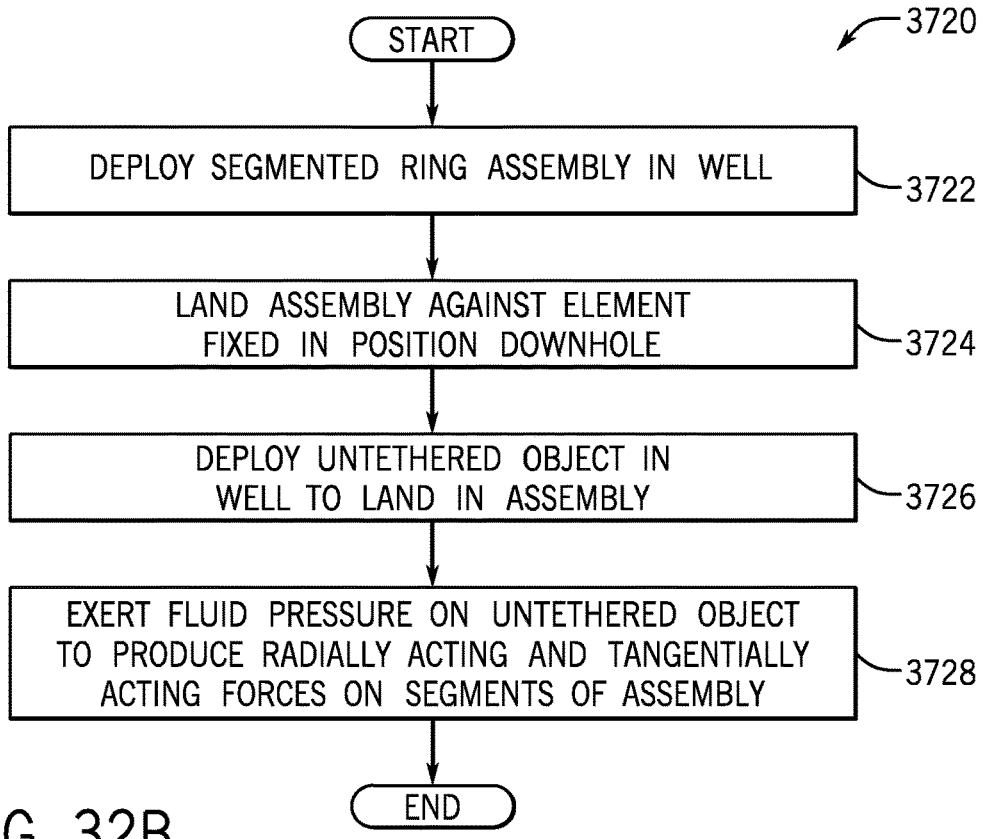

More specifically, in accordance with example implementations, a technique 3720, which is depicted in FIG. 32B, includes deploying (block 3722) a segmented ring assembly into a well and landing (block 3724) the assembly against an element that is fixed in position downhole. The technique 3720 includes deploying (block 3726) an untethered object in the well to land in the assembly. Fluid pressure may then be exerted (block 3728) on the untethered object to produce radial and tangential compression forces on segments of the assembly.

Figure 32C:
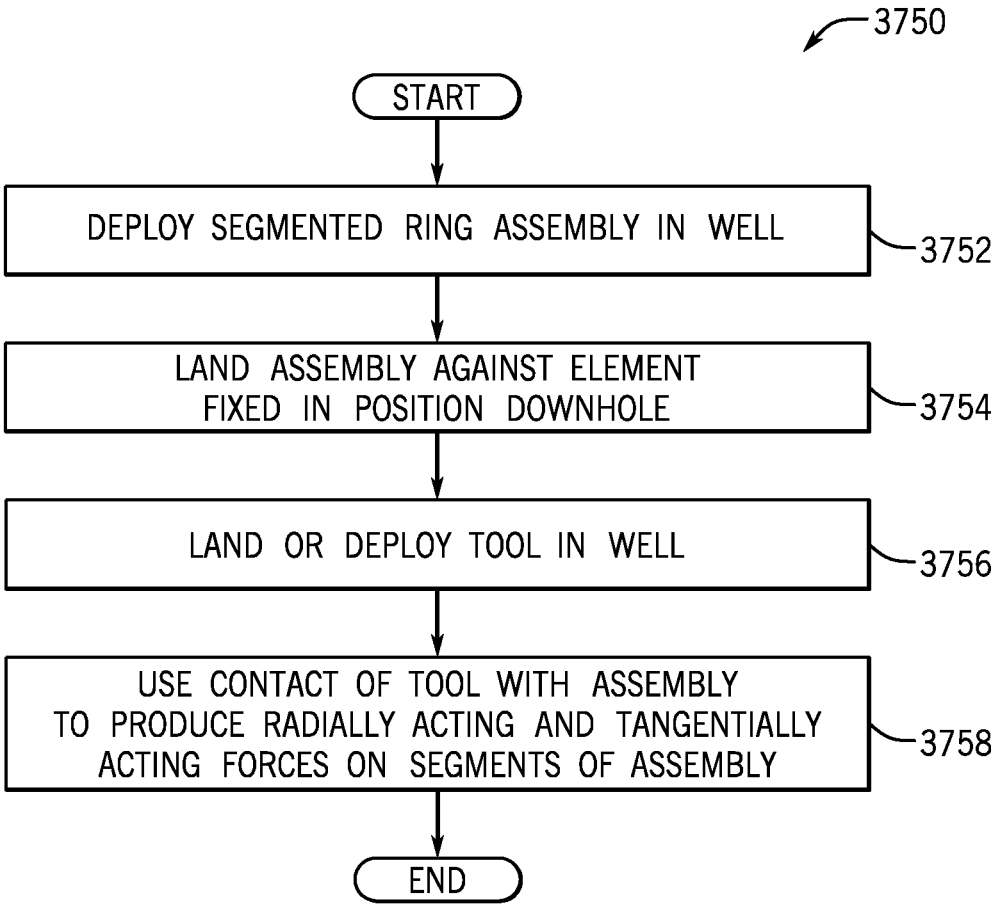

As another example, in accordance with further implementations, a technique 3750, which is depicted in FIG. 32C may be used. Pursuant to the technique 3750, a segmented ring assembly may be deployed in a well, pursuant to block 3752 and the assembly may be landed against an element that is fixed in position downhole, pursuant to block 3754. Next, a tool may be landed or deployed in the well, pursuant to block 3756 and used (block 3758) to exert one or more forces against the assembly to produce radial and tangential compression forces on segments of the assembly.

Other implementations are contemplated, which are within the scope of the appended claims. For example referring back to FIG. 29, the segments 3602 of the segmented ring assembly 3420 may or may not be the same, depending on the particular implementation. In this manner, as depicted in FIG. 29, a given segment 3602-1 of the ring assembly 3420 may have a different size than another segment 3602-1 of the assembly 3420. In this manner, some of the segments 3602 may be shorter or longer than other segments 3602, i.e., the segments 3602 may have different angle about the longitudinal axis 3402.

Although FIG. 28A depicts the profiled surface 3508 as being on the end of the tool 3504, in further example implementations, the profiled surface may be disposed on another portion of the tool. For example, in accordance with some implementations, a profiled surface may extend around the periphery of the tool at a location other than the tool's end.

Other implementations are contemplated, which are within the scope of the appended claims. For example, in accordance with further example implementations, using the second element to compress the first element may involve an actuation within the second element. As a more specific example, the second element may be formed from a tractor that contains an electrically or hydraulically actuated engine, for example, to generate a force to compress the first element.

In further example implementations, fluid may be pumped uphole from the segmented ring assembly for purposes of creating a force to compress the first element. The second element may be used deploy the first element downhole.

While a limited number of examples have been disclosed herein, those skilled in the art, having the benefit of this disclosure, will appreciate numerous modifications and variations therefrom. It is intended that the appended claims cover all such modifications and variations.

What is claimed is:

1. A method usable with a well, comprising:

deploying a segmented ring assembly in the well, wherein the segmented ring assembly is initially in a radially contracted state;

disposing the segmented ring assembly between a first element fixed in place in the well and a second unfixed element; wherein the segmented ring assembly is in a radially expanded state to engage the first element and receive the second unfixed element;

using the second element to compress the assembly to produce radially and tangentially acting forces on segments of the assembly;

forming a seal between the second element and a seat of the segmented ring assembly to form a fluid barrier in the well, the forming comprising: pumping at least one fluid into the well to enhance the seal between the second element and the seat, wherein the at least one fluid is selected from the group consisting of: two fluids having different viscosities; and a fluid containing fibers.

2. The method of claim 1, wherein deploying the segmented ring assembly comprises deploying a ring assembly having segments, where each of the segments is separate from the other segments and extends a sub angle about a longitudinal axis of the assembly relative to a total angle about which the assembly extends about the longitudinal axis.

3. The method of claim 1, further comprising using the segmented ring assembly to form a fluid barrier in the well.

4. The method of claim 1, further comprising using the tangentially acting forces to form seals between segments of the assembly.

5. The method of claim 4, wherein using the tangentially acting forces to form seals comprises forming metal-to-metal fluid seals between segments of the assembly.

6. The method of claim 1, further comprising:

using a non-metallic material attached to the segmented ring assembly to enhance the seal associated with the fluid barrier.

7. The method of claim 6, wherein using the non-metallic material comprises using a material coating deposited on the seat of the segmented ring assembly or a material overmolded onto the seat of the segmented ring assembly.

8. The method of claim 1, wherein disposing the segmented ring assembly between the first and second elements comprises disposing the segmented ring assembly between a tubular member fixed in place in the well and an untethered object deployed in the well after the deployment of the segmented ring assembly.

9. The method of claim 8, wherein the tubular member comprises a casing string, a tubing string, a valve assembly or a deformable tubing.

10. The method of claim 9, further comprising using at least one of a tool or the second element to deploy the segmented ring assembly.

11. The method of claim 9, further comprising using the tangentially acting forces to engage interlocking features of segments of the assembly.

12. The method of claim 8, wherein the tubular member comprises a shifting section of a fracturing valve assembly.

13. The method of claim 8, wherein the untethered object comprises a dart, a bar or an activation ball.

14. The method of claim 8, wherein using the second element to compress the assembly comprises exerting fluid pressure on the untethered object.

15. The method of claim 1, further comprising securing the first element in place in the well, wherein the securing comprises cementing the first element or securing the first element in an uncased wellbore using at least one packer.

16. The method of claim 1, wherein disposing the segmented ring assembly in the well comprises disposing the assembly between a tubular member secured in place in the well and a tool deployed in the well after the deployment of the assembly.

17. The method of claim 16, wherein using the second element to compress the assembly comprises moving the tool to cause a first profiled surface of the tool to engage a second profiled surface of the assembly.

18. The method of claim 16, wherein using the second element to compress the assembly comprises moving a coiled tubing, casing string, slickline or tubing string to exert forces on the assembly.

19. The method of claim 16, wherein using the second element comprises exerting forces on the assembly by an actuation within the second element.

20. The method of claim 9, wherein using the second element comprises pumping fluid uphole from the segmented ring assembly to compress the first element.

21. An apparatus usable with a well comprising:

arcuate-shaped segments, wherein the segments are adapted to form a continuous ring downhole in the well and, in response to being compressed between two elements in the well, produce radial and tangentially acting forces to form metal-to-metal fluid seals between the segments; and a non-metallic material attached to at least one of the arcuate-shaped segments to enhance a seal associated with a downhole fluid barrier, wherein one of the two elements is an untethered object selected from the group consisting of: a ball; a dart; and a bar, and wherein the seal associated with the downhole fluid barrier is formed between the untethered object and the continuous ring.

22. The apparatus of claim 21, wherein at least two of the segments extend along different angles about a longitudinal axis of the assembly when the assembly forms the ring.

23. The apparatus of claim 21, wherein the segments are adapted to direct the radial and tangential forces to form the metal-to-metal seals in response to the tangentially acting forces and radially expand in response to the radially acting forces being compressed between the untethered object and an object secured to the well.

24. The apparatus of claim 21, wherein the segments are adapted to direct the radially acting and tangentially acting forces to form the metal-to-metal fluid seals.

25. The apparatus of claim 21, wherein the material comprises a material coating deposited on a seat formed by the segments or a material overmolded onto the seat.

26. The apparatus of claim 21, further comprising an element to secure the arcuate segments in place in the well.

27. A system usable with a well, comprising:

a segmented ring assembly, the segmented ring assembly comprising:

arcuate-shaped segments, wherein the segments are adapted to form a continuous ring downhole in the well and, in response to being compressed, produce radially acting and tangentially acting forces to form metal-to-metal fluid seals between edges of the segments and radially expand the segments;

an object to compress the assembly to produce the radially acting and tangentially acting forces; and a seal between the object and the continuous ring forming a fluid barrier in the well, the seal formed by pumping at least one fluid into the well to enhance the seal between the object and the continuous ring, wherein the at least one fluid is selected from the group consisting of: two fluids having different viscosities; and a fluid containing fibers.

28. The system of claim 27, wherein the object comprises an untethered object.

29. The system of claim 27, wherein the object comprises a downhole tool adapted to compress the assembly to form a fluid barrier in the well and perform a function in addition to forming the fluid barrier.

30. The system of claim 29, wherein the tool comprises a tool performing other actions selected from the list including: measurement, perforation, conveyance, fluid diversion or setting the segmented ring assembly and having a profiled surface to engage a profiled surface of the segmented ring assembly.

31. The system of claim 27, wherein the arcuate-shaped segments are adapted to form a frustoconical surface to form a metal-to-metal fluid seal between the segmented ring assembly and a tubular member in the well.

32. A method comprising:

deploying a segmented ring assembly in a radially collapsed state into a tubular string;

radially expanding the segmented ring assembly to form a continuous ring;

disposing the segmented ring assembly between an element fixed in place in the tubular string and an untethered object selected from the group consisting of: a ball; a dart; and a bar;

receiving the untethered object onto the continuous ring of the segmented ring assembly, the continuous ring producing radial and tangentially acting forces to form metal-to-metal fluid seals between segments of the continuous ring in response to being compressed between the first element and the untethered object;

forming a seal between the untethered object and the continuous ring to form a fluid barrier;

using a non-metallic material attached to the segmented ring assembly to enhance the seal associated with the fluid barrier; and using the untethered object to compress the assembly to produce radially and tangentially acting forces on segments of the assembly.

* * * * *